US006537115B2

(12) United States Patent
Suganuma et al.

(10) Patent No.: US 6,537,115 B2
(45) Date of Patent: Mar. 25, 2003

(54) OIL PUMP CONSTRUCTION FOR WATERCRAFT ENGINE

(75) Inventors: Noboru Suganuma, Hamamatsu (JP); Masaki Takegami, Hamamatsu (JP); Keiya Funahashi, Hamamatsu (JP)

(73) Assignee: Sanshin Kogyo Kabushiki Kaisha, Hamamatsu ( * ) Notice: Subject to any disclaimer, the term of this patent is extended or adjusted under 35 U.S.C. 154(b) by 0 days.

(21) Appl. No.: 09/815,421

(22) Filed: Mar. 22, 2001

(65) Prior Publication Data

US 2001/0024914 A1 Sep. 27, 2001

(30) Foreign Application Priority Data

Mar. 22, 2000 (JP) ..... 2000-080603
Mar. 22, 2000 (JP) ..... 2000-080604
Mar. 22, 2000 (JP) ..... 2000-080648

(51) Int. Cl.[7] ..... B63H 21/38

(52) U.S. Cl. ..... 440/88; 123/90.31; 123/198 C; 184/6.13; 184/6.28; 440/75

(58) Field of Search ..... 440/88, 83, 75, 440/38; 123/196 R, 198 C, 90.31; 184/6.13, 6.28, 6.5

(56) References Cited

U.S. PATENT DOCUMENTS 2,963,006 A * 12/1960 Karde ..... 123/190.2
3,868,833 A * 3/1975 Noe et al. ..... 416/188
4,834,219 A * 5/1989 Inagaki et al. ..... 184/31
4,909,176 A 3/1990 Kobayashi
5,390,621 A 2/1995 Hattori et al.
5,438,946 A 8/1995 Kobayashi
5,511,505 A 4/1996 Kobayashi et al.
5,558,549 A 9/1996 Nakase et al.
5,607,332 A 3/1997 Kobayashi et al.
5,634,422 A 6/1997 Kobayashi et al.
5,634,832 A 6/1997 Nakase et al.
5,664,515 A 9/1997 Hattori et al.
5,669,326 A 9/1997 Ikeda
5,676,086 A 10/1997 Watkins
5,778,833 A 7/1998 Kuranishi
5,839,930 A 11/1998 Nanami et al.
5,846,102 A * 12/1998 Nitta et al. ..... 123/196 AB
5,887,564 A * 3/1999 Kawamoto ..... 123/196 R
5,899,779 A 5/1999 Hattori
5,951,343 A 9/1999 Nanami et al.
5,957,072 A 9/1999 Hattori
6,029,638 A 2/2000 Funai et al.

FOREIGN PATENT DOCUMENTS

JP 7-237587 12/1995
JP 9-315383 9/1997
JP 11-280443 10/1999

OTHER PUBLICATIONS

Co–pending patent application: Ser. No. 09/497,569, filed Feb. 3, 2000, entitled Lubrication System For Small Watercraft, in the name of Masayoshi Nanami, and assigned to Yamaha Hatsudoki Kabushiki Kaisha.

(List continued on next page.)

*Primary Examiner*—Sherman Basinger
(74) *Attorney, Agent, or Firm*—Knobbe, Martens, Olson & Bear, LLP

(57) ABSTRACT

A lubrication system for an internal combustion engine includes an oil pump assembly driven by the crankshaft. The oil pump can be mounted in various positions for maintaining a low center of gravity of the engine. Optionally, or in addition, the engine can include a bearing disposed between a valvetrain drive gear and an output drive gear.

44 Claims, 23 Drawing Sheets

OTHER PUBLICATIONS

Co–pending patent application: Ser. No. 09/595,676, filed Jun. 19, 2000, entitled Vapor System Arrangement For Marine Engine, in the name of Masayoshi Nanami, and assigned to Yamaha Hatsudoki Kabushiki Kaisha.

Co–pending patent application: Ser. No. 09/595,964, filed Jun. 19, 2000, entitled Induction System For Small Watercraft, in the name of Masayoshi Nanami, and assigned to Yamaha Hatsudoki Kabushiki Kaisha.

Co–pending patent application: Ser. No. 09/764,949, filed Jan. 17, 2001, entitled Induction System For 4–Cycle Engine OF Small Watercraft, in the name of Tetsuya Mahiko and Masaki Takegami, and assigned to Yamaha Hatsudoki Kabushiki Kaisha.

Co–pending patent application: Ser. No. 09/775,354, filed Jan. 31, 2001, entitled Lubrication System For 4–Cycle Engine Of Small Watercraft, in the name of Noboru Suganuma, and assigned to Yamaha Hatsudoki Kabushiki Kaisha.

European search report, Oct. 14, 2002, Application No. EP 01107 080.2.

* cited by examiner

OIL PUMP CONSTRUCTION FOR WATERCRAFT ENGINE

PRIORITY INFORMATION

This application is based n and claims priority to Japanese Patent Applications No. 2000-080603, filed Mar. 22, 2000, No. 2000-080604, filed Mar. 22, 2000, and No. 2000-080648, filed Mar. 22, 2000, the entire contents of which are hereby expressly incorporated by reference.

BACKGROUND OF THE INVENTION

1. Field of the Invention

This invention relates to an engine for a watercraft, and particularly to an improved crankshaft bearing and lubrication system of an engine for a watercraft.

2. Description of the Related Art

Personal watercraft have become very popular in recent years. This type of watercraft is quite sporting in nature and carries one or more riders. A relatively small hull of the personal watercraft defines a rider's area above an engine compartment. An internal combustion engine powers a jet propulsion unit which propels the watercraft. The engine lies within the engine compartment in front of a tunnel formed on the underside of the hull. A jet propulsion unit, which includes an impeller, is placed within the tunnel. The impeller has an impeller shaft driven by the engine. The impeller shaft extends between the engine and the jet propulsion device through a bulkhead of the hull tunnel.

Typically, two-cycle engines are used in personal watercraft because two-cycle engines have a fairly high power to weight ratio. One disadvantage of two-cycle engines, however, is that they produce relatively high emissions. In particular, large amounts of carbon monoxide and hydrocarbons are produced during operation of the engine. When steps are taken to reduce these emissions, other undesirable consequences typically result, such as an increase in weight of the engine, the cost of manufacture, and/or the reduction of power.

It has been suggested that four-cycle engines replace two-cycle engines in personal watercraft. Four-cycle engines typically produce less hydrocarbon emissions than two-cycle engines while still producing a relatively high power output. However, adapting four-cycle engines for use in personal watercraft has its own engineering and technical challenges due to, at least in part, the limited space available within the hull of a personal watercraft.

A four cycle engine utilizes a more complex lubrication system as compared with a two-cycle engine. In a four-cycle engine, a reservoir of oil is held in an oil pan below the crankcase to be available for circulation by an oil pump. One approach to enabling the use of a four-cycle engine in personal watercraft applications is to provide the engine with a dry sump lubrication system. A dry sump system utilizes a shallow reservoir of oil available for the oil pump as compared with the volume of oil in a wet sump system having an oil pan, thus reducing the overall height of the engine.

SUMMARY OF THE INVENTION

In accordance with one aspect of the present invention, an internal combustion engine has an engine body which defines at least one combustion chamber. A crankshaft is journaled for rotation at least partially within the engine body. At least one piston cooperates with the engine body to define the combustion chamber. A valvetrain is also provided which is configured to control a flow of air into, and exhaust gas out of, the combustion chamber. A valvetrain drive assembly is configured to transmit energy from the crankshaft to the valvetrain for operating the valvetrain. The engine further comprises a valvetrain drive assembly having a first drive member driven by the crankshaft. A second drive member is also connected to the crankshaft which drives an output shaft. Both the first and second drive members are disposed proximate to a first end of the crankshaft and a bearing is disposed between the first and second drive members.

By providing the bearing between the first and second drive members, the crankshaft can be made more easily. Also, since part of the load is carried by a bearing at one end of the crankshaft, the size of the crankshaft can be reduced. This makes the overall size of the crankshaft smaller and also makes it easier to tune, or balance, for acceptable performance.

According to another aspect of the present invention, an internal combustion engine comprises an engine body defining at least one combustion chamber. A crankshaft is journaled for rotation at least partially within the engine body. The crankshaft has a first and second end, and at least one piston cooperates with the engine body to define the combustion chamber. A drive gear is connected to the first end of the crankshaft. An output shaft assembly is driven by the drive gear. A lubrication system is configured to circulate lubricant through at least one lubricant gallery defined in the engine body. The lubrication system comprises at least one oil pump having an oil pump gear driven by the output shaft assembly.

According to a further aspect of the present invention, an internal combustion engine comprises an engine body defining at least one combustion chamber. A crankshaft is journaled for rotation at least partially within the engine body and includes first and second ends. At least one piston cooperates with the engine body to define the combustion chamber. An output shaft assembly is driven by the crankshaft. A lubrication system is configured to circulate lubricant through at least one lubricant gallery defined in the engine body. The lubrication system comprises at least one lubricant collection passage disposed in the lower portion of the engine body. The lubrication system also comprises an oil pump having an oil pump shaft disposed at an elevation between the output shaft assembly and the lubricant collection passage. The oil pump shaft is offset from the output shaft assembly relative to a vertical plane containing the rotational axis of the output shaft assembly.

Further aspects, features and advantages of this invention will become apparent from the detailed description of the preferred embodiments which follow.

BRIEF DESCRIPTION OF THE DRAWINGS

These and other features, aspects and advantages of the present invention will now be described with reference to the drawings of preferred embodiments which are intended to illustrate and not to limit the invention. The drawings comprise 23 figures.

DETAILED DESCRIPTION OF THE PREFERRED EMBODIMENT OF THE INVENTION

Figure 1:
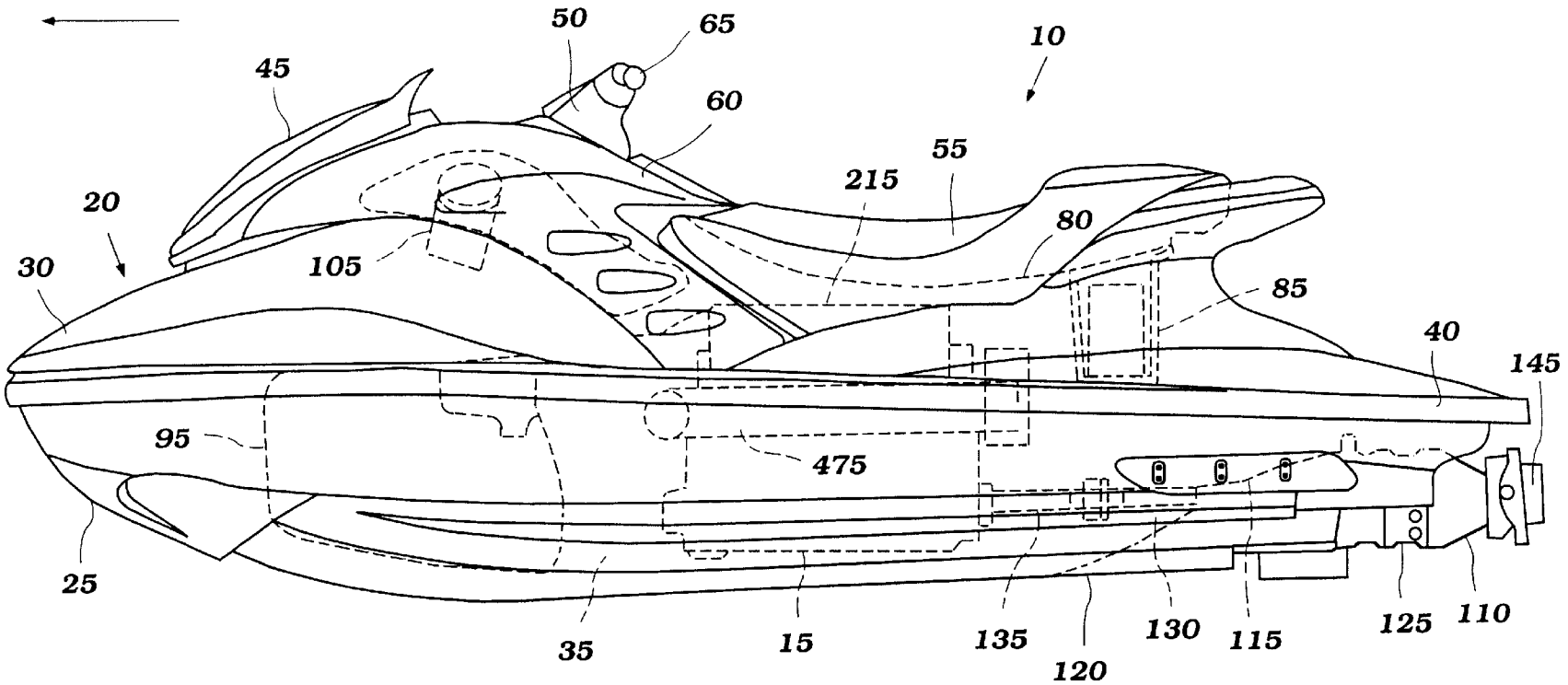
FIG. 1 is a side elevational view of a personal watercraft of the type powered by an engine configured in accordance with a preferred embodiment of the present invention. Several of the internal components of the watercraft (e.g., the engine) are illustrated in phantom.
Figure 2:
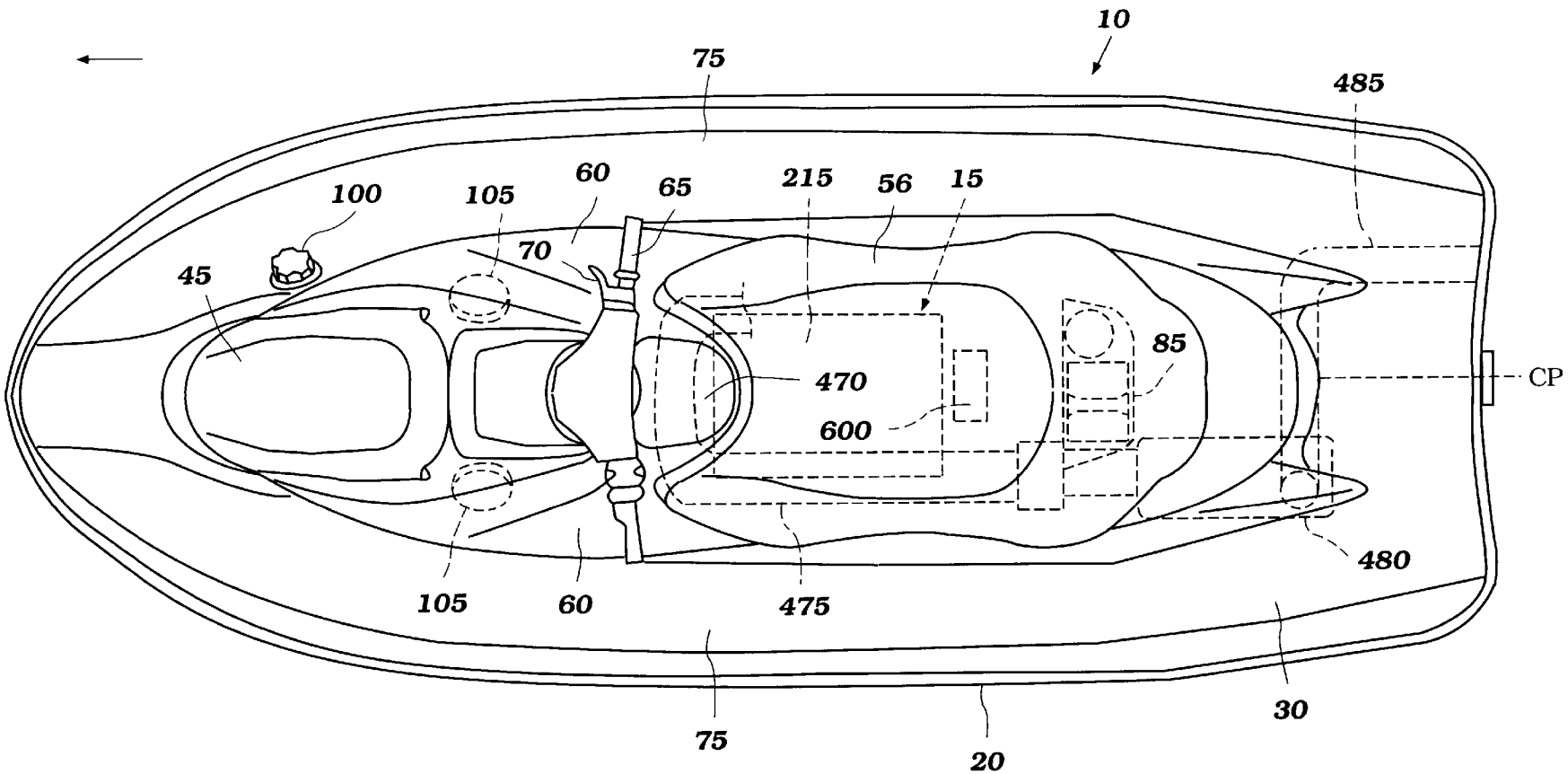
FIG. 2 is a top view of the watercraft illustrated in FIG. 1.

With reference to FIGS. 1 to 2, a watercraft 10 employs an internal combustion engine configured in accordance with a preferred embodiment of the present invention. The described engine configuration has particular utility with personal watercraft, and thus, is described in the context of a personal watercraft. The engine configuration, however, can be applied to other types of recreational vehicles as well, such as, for example, small jet boats and other off-road vehicles.

The personal watercraft 10 includes a hull 20 formed with a lower hull section 25 and an upper hull section or deck 30. The lower hull section has a stopper surface 32 (FIG. 14) which provides support to various engine components, as described in more detail below.

Figure 3:
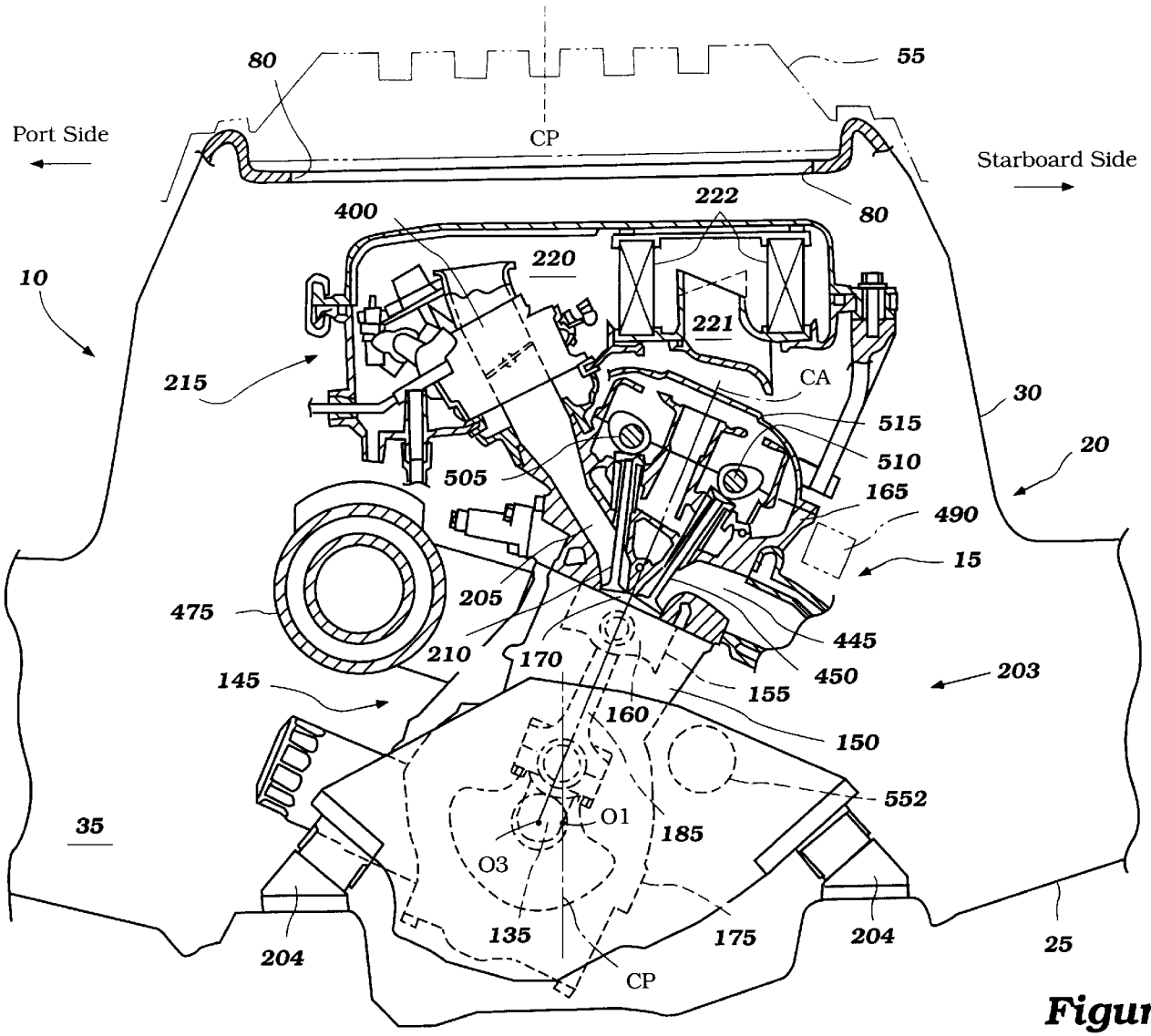
FIG. 3 is a partial cross-sectional rear view of the watercraft and the engine. The engine and an opening of the engine compartment of the hull are illustrated partially in section.

Both of the hull sections 25, 30 are made of, for example, a molded fiberglass reinforced resin or a sheet molding compound. The lower hull section 25 and the upper hull section 30 are coupled together to define an internal cavity including an engine compartment 35. A gunnel 40 defines an intersection of both the hull sections 25, 30. With reference to FIGS. 2 and 3, the hull defines a center plane CP that extends generally vertically from bow to stern. Along the center plane CP, the upper hull section 20 includes a hatch cover 45, a control mast 50 and a seat 55 arranged from fore to aft.

A bow portion 60 of the upper hull section 30 slopes upwardly and an opening (not shown) is provided through which the rider can access the internal cavity 35. The hatch cover 45 is detachably affixed (e.g., hinged) to the bow portion 60 so as to cover the opening.

The control mast 50 extends upwardly to support a handlebar 65. The handlebar 65 is provided primarily for controlling the direction in which the water jet propels the watercraft 10, in a known manner. Grips are formed at both ends of the bar 65 so that the rider can hold the handlebar 65. The handlebar 65 also carries controls such as, for example, a throttle lever 70 that is used for control of the running conditions of the engine 15.

The seat 55 extends along the center plane CP from the rear of the bow portion 60. The seat 55 also generally defines the rider's area. The seat 55 has a saddle shape and thus a rider can sit on the seat 55 in a straddle-type fashion.

Foot areas 75 are defined on both sides of the seat 55 and on the upper hull section 30. The foot areas 75 are generally flat. A cushion is supported by the upper hull section 30 and forms the seat 55. The seat 55 is detachably attached to the upper hull section 30. An access opening 80 is defined under the seat 55 through which the rider can also access the internal cavity 35. That is, the seat 55 usually closes the access opening 80. A storage box 85 preferably is disposed under the seat 55.

A fuel tank 95 is disposed in the cavity 35 and toward the bow portion 60 of the upper hull section 30. The fuel tank 95 is coupled with the fuel inlet port which is positioned at a top surface of the upper hull section 30, through a duct (not shown). As shown in FIG. 2, a closure cap 100 closes the fuel inlet port.

Figure 4:
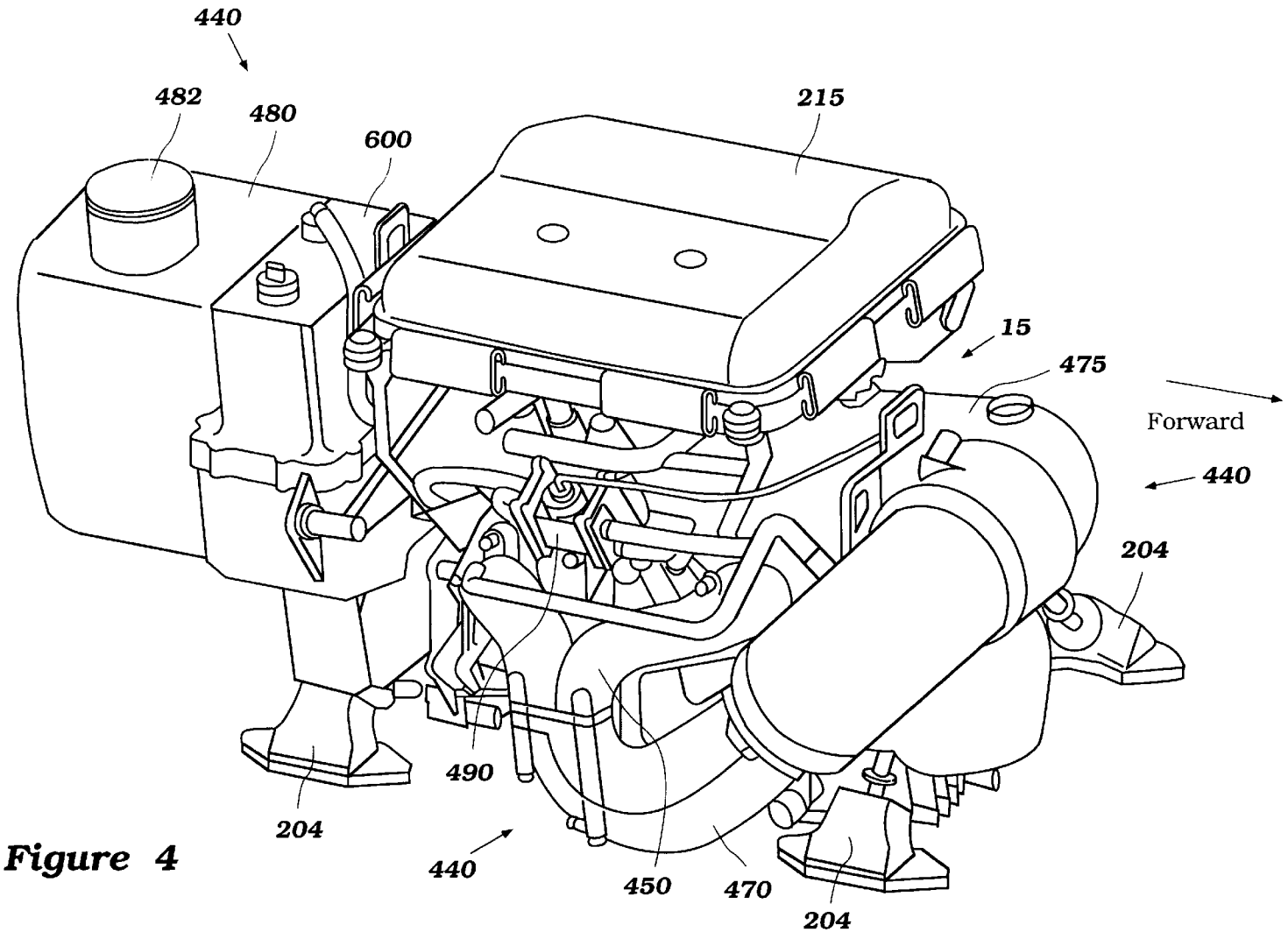
FIG. 4 is a top, front, and starboard side perspective view of the engine shown in FIG. 3.
Figure 5:
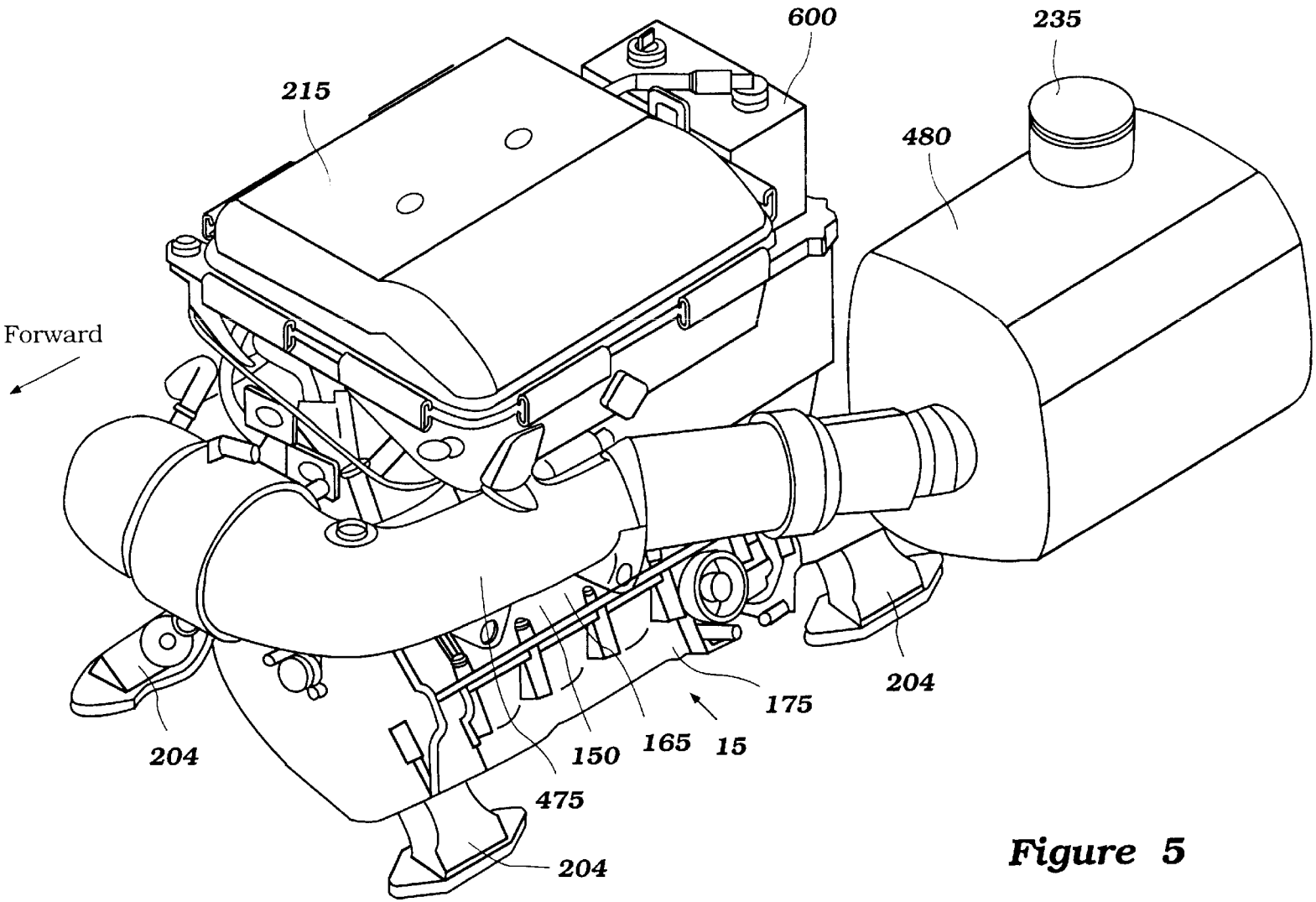
FIG. 5 is a top, front, and port side perspective view of the engine shown in FIG. 3.
Figure 6:
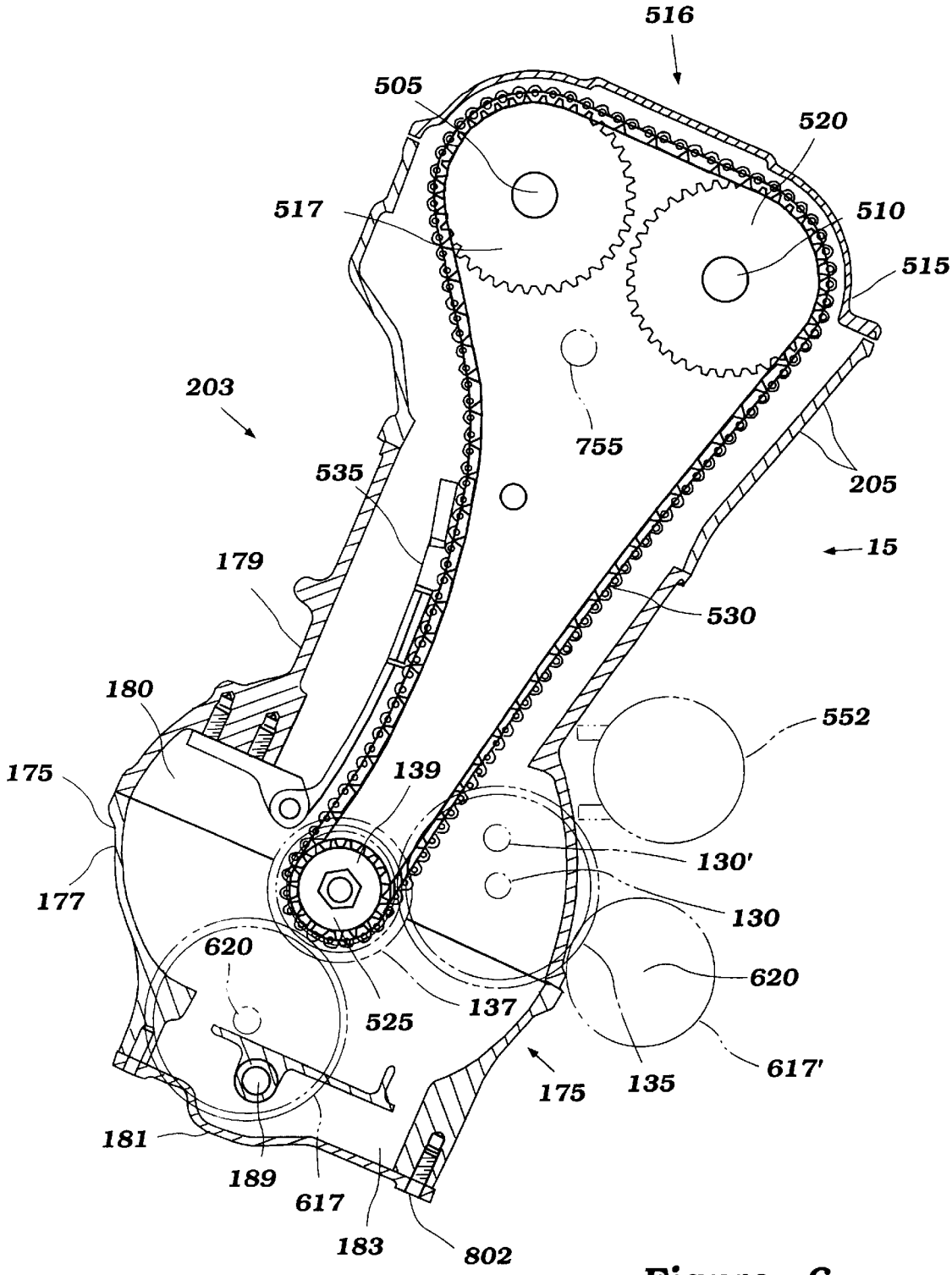
FIG. 6 is a cross-sectional view of the engine showing the a cam chamber. Also shown in phantom are alternate locations of the oil pump driven gear and alternate locations for the impeller shaft an associated driven gear.

With reference to FIGS. 4–6, the engine 15 is disposed in the engine compartment 35. The engine compartment 35 preferably is located at least under the seat 55, but other locations are also possible (e.g., beneath the control mast or in the bow). The rider thus can access the engine in the illustrated embodiment through the access opening 80 by detaching the seat 55.

A pair of ventilation ducts 105 are provided preferably on both sides of the bow portion 60 so that the ambient air can enter the engine compartment 35 therethrough. Except for the air ducts 105, the engine compartment is substantially sealed so as to protect the engine 15 and other components from water.

With reference to FIG. 1, a jet pump unit 110 is configured to propel the watercraft 10. The jet pump unit 110 is disposed in a tunnel 115 formed on the underside of the lower hull section 25. The tunnel 115 has a downward facing inlet port 120 opening toward the body of water. A jet pump housing 125 is disposed within a portion of the tunnel 115 and communicates with the inlet port 120. An impeller (not shown) is rotatably supported within the housing 125.

Figure 7:
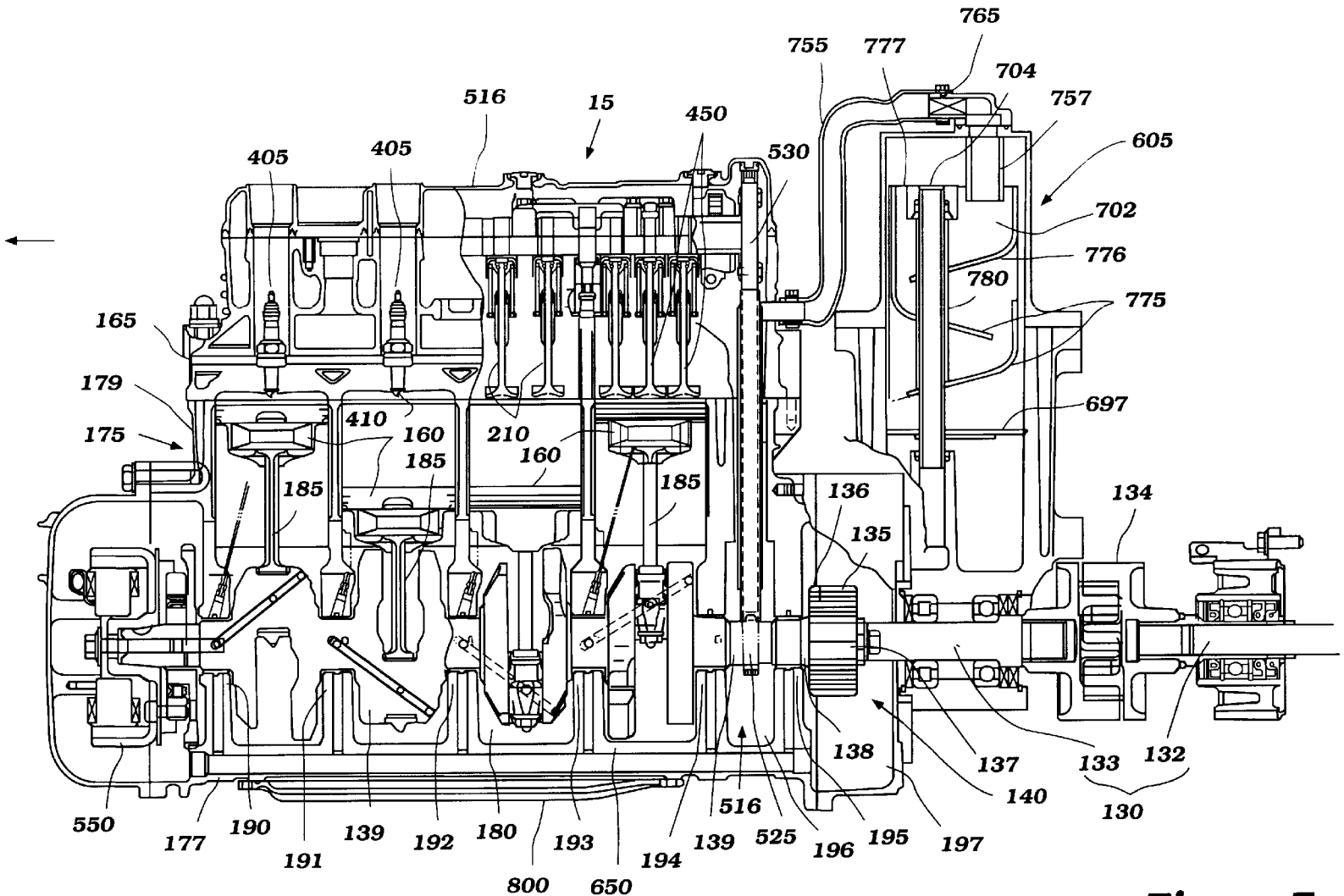
FIG. 7 is a partial cross-sectional view of the engine viewed from the port side showing an oil tank assembly towards a rear end thereof.

With reference to FIG. 7, a driveshaft assembly 130 extends forwardly from the jet pump unit 110. The driveshaft assembly is comprised of an impeller shaft 132 coupled to a drive shaft 133 through a vibration isolation coupling 134. A driven gear 135 is positioned on the forward most end of the drive shaft 133. Just forward of the driven gear is a backlash prevention gear 136. The engine 15 drives the driveshaft assembly 130, described below in more detail.

The rear end of the housing 125 defines a discharge nozzle and a steering nozzle 145 is affixed to the discharge nozzle for pivotal movement about a steering axis extending generally vertically. The steering nozzle 145 is connected to the handlebar 65 by a cable so that the rider can pivot the nozzle 145, in a known manner. When the impeller is rotated, water is drawn from the surrounding body of water through the inlet port 120. The pressure generated in the housing 125 by the impeller produces a jet of water that is discharged through the steering nozzle 145. This water jet propels the watercraft 10. The rider can move the steering nozzle 145 with a handlebar 65 when he or she desires to turn a watercraft in either direction.

The engine 15 operates on a four-stroke cycle combustion principle. With reference to FIGS. 3 and 7, the engine 15 includes a cylinder block 150. The cylinder block 150 defines four cylinder bores 155 spaced from each other from fore to aft. The engine 15 thus is an L4 (in-line four-cylinder) type. The illustrated engine, however, merely exemplifies one type of engine on which various aspects and features of the present invention can be used. Engines having other numbers of cylinders, having other cylinder arrangements, other cylinder orientations (e.g., upright cylinder banks, V-type, W-type) and operating on other combustion principles (e.g., two-stroke, diesel, and rotary) are all practicable.

Each cylinder bore 155 has a cylinder axis CA that is slanted or inclined at an angle from the center plane CP so that the engine 15 can be shorter in height. All the center axes CA in the illustrated embodiment are inclined at the same angle.

Pistons 160 reciprocate within cylinder bores 155. A cylinder head 165 is affixed to the upper end of the cylinder block 150 to close respective upper ends of the cylinder bores and thus define the combustion chambers 170 with cylinder bores and the pistons 160.

With reference to FIG. 6, a crankcase member 175 is affixed to the lower end of the cylinder block 150 to define a crankcase chamber 180. With reference to FIG. 7, the crankshaft 139 is rotatably connected to the pistons 160 through connecting rods 185. That is, the connecting rods 185 are rotatably coupled with the pistons 160 and with the crankshaft 139. The crankshaft 139 is also journaled in the crankcase member 175 by bearings 190, 191, 192, 193, 194, 195. The positioning and operation of bearings 190 to 195 is described below in greater detail.

A drive gear 137 is mounted on the rear portion 138 of the crankshaft 139. A driven gear 135 is provided at a forward end of the drive shaft 133. The drive gear 137 is smaller than the driven gear 135 and thus, a gear reduction pair 140 is formed. The crankshaft 139 of the engine 15 thus drives the driveshaft assembly at an angular speed which is less than angular speed of the crankshaft by an amount determined by the gear reduction 140.

The cylinder block 150, the cylinder head member 165 and the crankcase member 175 together define an engine body 203. The engine body 203 preferably is made of an aluminum-based alloy. In the illustrated embodiment, the engine body 203 is oriented in the engine compartment so as to position the crankshaft 139 generally parallel to the central plane CP and to extend generally in the longitudinal direction. Other orientations of the engine body, of course, are also possible (e.g., with a transverse or vertically-oriented crankshaft).

Engine mounts 204 extend from both sides of the engine body 203. Engine mounts 204 preferably include resilient portions made of, for example, a rubber material. The engine 15 preferably is mounted on the lower hull section 25, specifically a hull liner, by the mounts 204 so that vibration of the engine 15 is inhibited from conducting to the hull section 25.

Figure 8:
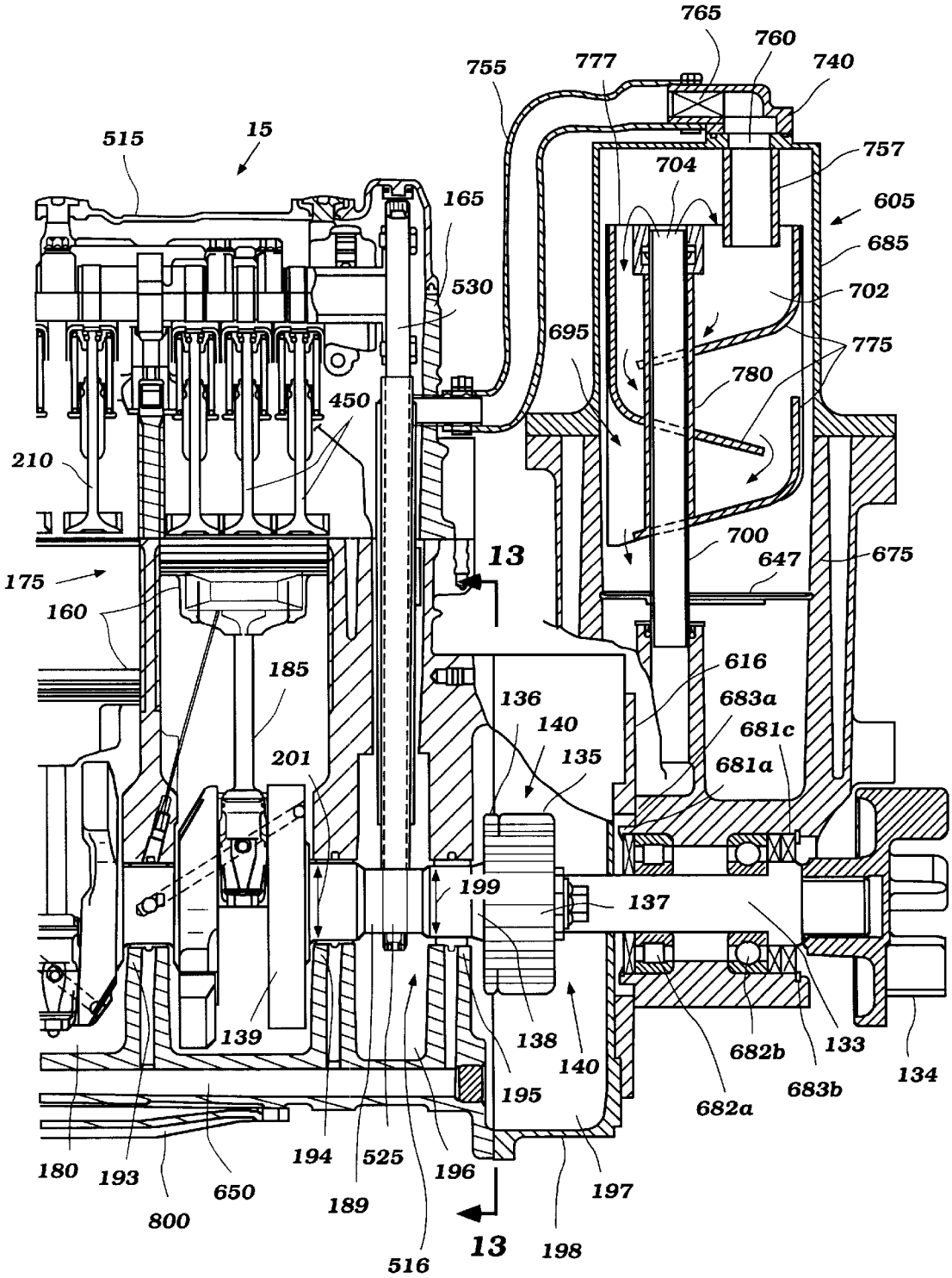
FIG. 8 is an enlarged cross-sectional view of a rear portion of the engine shown in FIG. 7.

With reference to FIGS. 7 and 8, the crankshaft 139 is supported by the bearings 190–195. The first bearing 190 is located just forward of the forward-most cylinder 180. The bearing 191 is located just aft of the forward-most cylinder 180. The bearing 192 is located just aft of the second forward-most cylinder 180. The bearing 193 is located just aft of the third forward-most cylinder 180. The bearing 194 is located just aft of the aft-most cylinder 180. Just aft of crankshaft bearing 194, the crankshaft 139 passes through a valvetrain drive chamber 196 formed in the crankcase member 175. The crankshaft 139 is supported by the bearing 195 on the aft side of the valvetrain drive chamber 196, and extends through the crankcase member 175 into a gear chamber 197 defined in part by a gear box cover 198. The gear box cover 198 preferably is made of aluminum alloy.

With reference to FIG. 3, the engine 15 also includes an air induction system configured to guide air into the combustion chamber 170. In the illustrated embodiment, the air induction system includes eight (8) intake ports 205 defined in the cylinder head member 165, two per combustion chamber. The intake ports 205 communicate with the associated combustion chambers 170. Intake valves 210 are provided to selectively connect and disconnect the intake port 205 with the combustion chambers 170. That is, the intake valves 210 selectively open and close the intake ports 205.

With reference to FIGS. 3–5, the air induction system also includes an air intake box 215 or a "plenum chamber" for smoothing intake air and acting as an intake silencer. The intake box 215 in the illustrated embodiment is generally rectangular and defines a plenum chamber 220. The intake box 215 includes inlet ports 221 which are configured to allow air from the engine compartment 35 to enter the plenum chamber 220. Additionally, the intake box 215 includes an air filter element 222 which is disposed between the inlet ports 221 and the remainder of the plenum chamber 220. Preferably, the air filter element 222 comprises a water-repellant and oil resistant element. One of ordinary skill in the art recognizes that other shapes of the intake box are possible, but it is desired to make the plenum chamber as large as possible in the space provided in the engine compartment. In the illustrated embodiment, a space is defined between the top of the engine 15 and the bottom of the seat 55. Due to the inclined orientation of the engine 15 rectangular shape of at least a principal portion of the intake box 215 conforms to this space.

The intake box 215 preferably is made of plastic or synthetic resin, although metal or other materials can be used. The intake box 215 can be formed with upper and lower chamber members, or the chamber member can be formed by a different number of members and/or can have a different assembly orientation (e.g., side-by-side).

The engine 15 also includes a fuel supply system. The fuel supply system includes the fuel tank 95 and a charge former 400 such as a carburetor or a combination of a throttle body and fuel injector. The charge former 400 is connected to the intake port 205.

The fuel supply system also includes at least one fuel pump configured to supply fuel to the charge former 400. Depending on the type of charge former used, the fuel supply system can include a low pressure fuel pump, a vapor separator, a high pressure fuel pump and a pressure regulator. Fuel supplied from the fuel tank 95 is delivered to the charge former 400 through any combination of such fuel pumps.

The charge former 400 is in communication with the air induction system and with the fuel system to produce an air fuel mixture appropriate for the running conditions of the engine 15 in a known manner. As such, the charge former 400 delivers the mixed air fuel charge to the combustion chamber 170 when the intake ports 205 are opened to the combustion chambers 170 by the intake valves 210.

The engine 15 further includes an ignition system. With reference to FIG. 7, spark plugs 405, at least one for each of the combustion chambers 170, are affixed to the cylinder head member 165 so that electrodes 410, which are defined at one end of the spark plugs 405, are exposed to the respective combustion chambers 170. Plug caps (not shown) are detachably coupled with the other ends of spark plugs 405. The plug caps have electrical connection with the plugs 405 and electrical power is supplied to the plug 405 through power cables (not shown) and the plug caps. Spark plugs 405 preferably are fired according to an ignition timing under control of an Electronic Control Unit (ECU) (not shown). The air/fuel charge is combusted during every combustion stroke accordingly.

With reference to FIG. 4, the engine 15 also includes an exhaust system 440 configured to discharge burnt charges, i.e., exhaust gases, from the combustion chambers 170. With reference to FIG. 3, the exhaust system 440 includes twelve (12) exhaust ports 445, three for each of the combustion chambers 170. The exhaust ports 445 are defined in the cylinder head member 165 and communicate with the associated combustion chambers 170. Exhaust valves 450 are provided to selectively connect and disconnect the exhaust ports 445 with the combustion chambers 170. That is, the exhaust valves 450 selectively open and close the exhaust ports 445.

With reference to FIG. 4, the exhaust system includes an exhaust manifold 450. In a presently preferred embodiment, the manifold 450 is coupled with the exhaust ports 445 on the starboard side of the engine 15 to receive exhaust gases from the respective exhaust ports 445. The downstream ends of the exhaust manifold 450 is coupled with an exhaust conduit 470, which, in turn, is coupled with an exhaust pipe 475 which extends around the rear side of the engine body 203.

An exhaust pipe 475 is connected to the exhaust conduit 470 and extends forwardly along the port side of the engine body 203. The exhaust pipe 475 is also connected to a water-lock 480 at a forward surface of the water-lock 480. The water-lock 480 also includes an outlet 482.

With reference to FIG. 2, a discharge pipe 485 extends from the outlet 482 of the water-lock 480 and transversely across the center plane CP. The discharge pipe 485 then extends rearwardly and opens at a stern of the lower hull section 25 in a submerged position. The water-lock 480 inhibits the water in the discharge pipe 45 from entering exhaust pipe 475.

The engine 15 further includes a cooling system configured to circulate coolant into thermal communication with at least one component within the watercraft 10. Preferably, the cooling system is an open-type cooling system, circulating water from the body of water in which the watercraft 10 is operating, into thermal communication with heat generating components within the watercraft 10. However, other types of cooling systems can be used, such as, for example, without limitation, closed-type liquid cooling systems using lubricated coolants and air-cooling types.

The cooling system includes a water pump arranged to introduce water from the body of water surrounding the watercraft 10, and a plurality of water jackets defined, for example, in the cylinder block 150 and the cylinder head member 165. The jet propulsion unit preferably is used as the water pump with a portion of the water pressurized by the impeller being drawn off for the cooling system, as known in the art.

Figure 10:
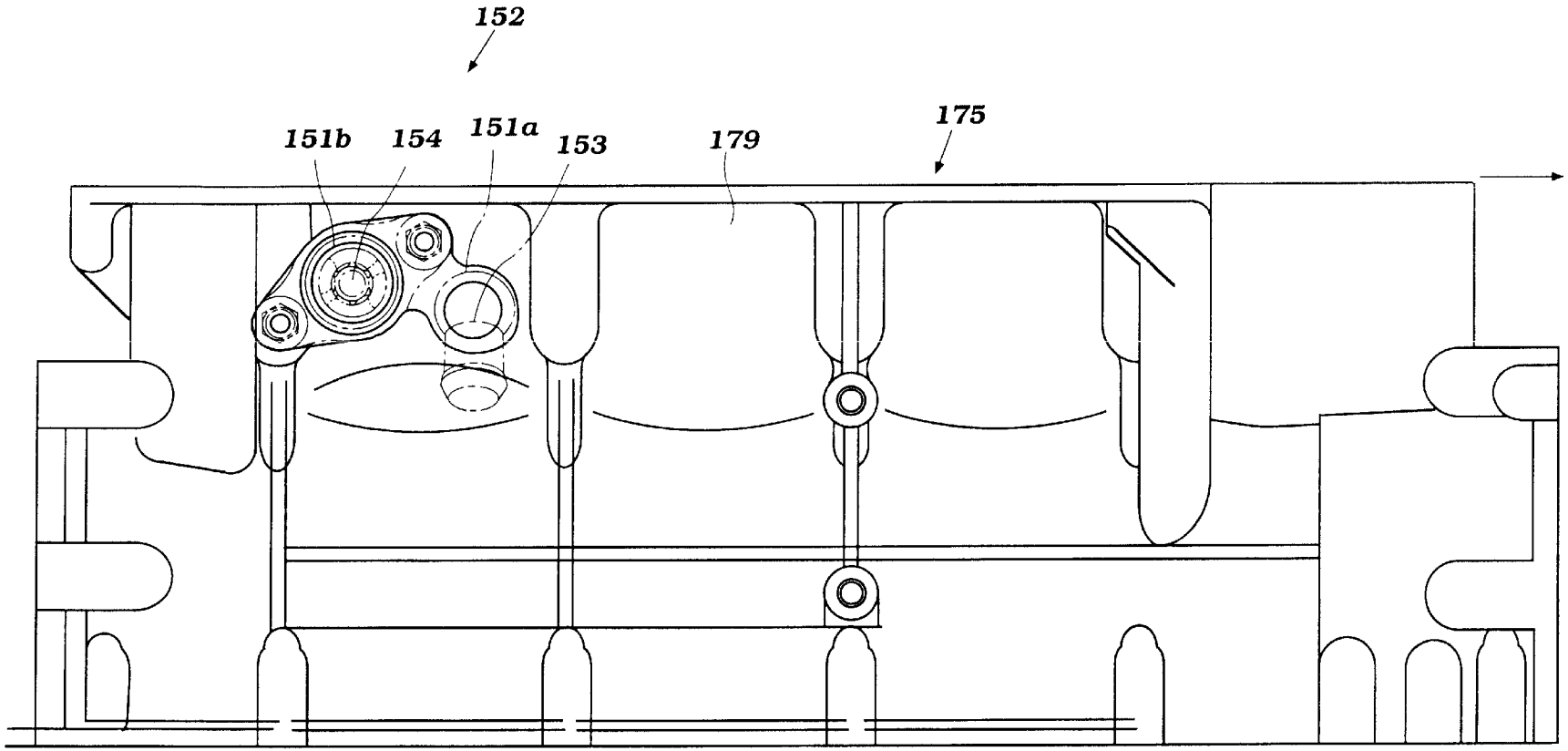
FIG. 10 is a bottom view of the crankcase with the cap removed.
Figure 11:
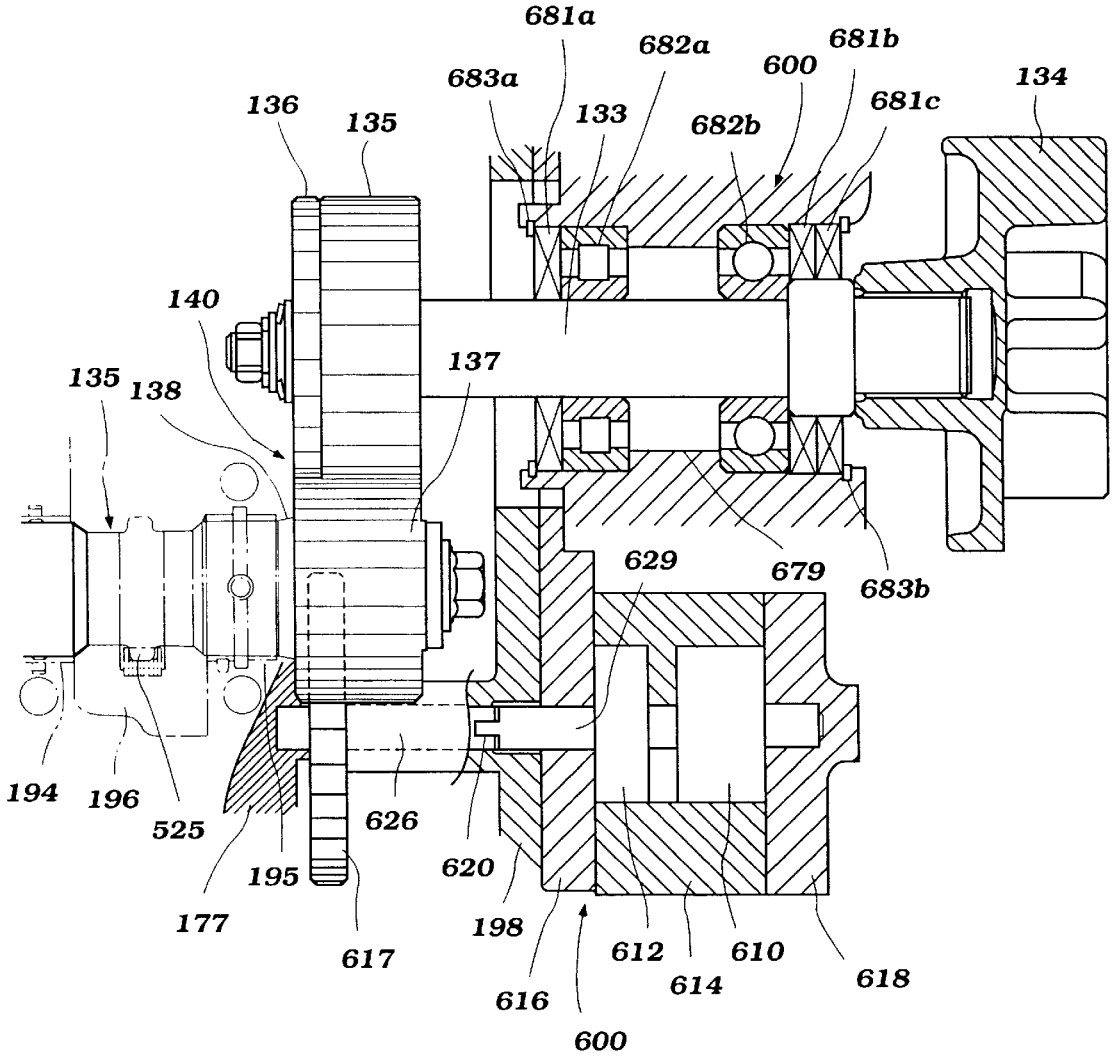
FIG. 11 is a partial sectional top plan view of an oil pump and output shaft assembly.

With reference to FIGS. 10 and 11, the engine body 203 preferably includes mounting surfaces 151*a*, 151*b* for a cooling water inlet and sacrificial anode assembly 152. As shown in FIG. 10, the assembly 152 includes a cooling water inlet nipple 153 and a sacrificial anode 154 disposed in electrical contact therewith. As such, the anode attenuates the affects of corrosion caused by contact with water.

Although the water is primarily used for cooling these engine portions, part of the water is used also for cooling the exhaust system 440. That is, the engine 15 preferably has at least an engine cooling system and an exhaust cooling system. The water directed to the exhaust cooling system preferably passes through a separate channel apart from the channel connected to the engine cooling system. The exhaust components 470 are formed as dual passage structures in general. More specifically, water jackets are defined around respective exhaust passages. The water cooling system is also described below its reference to the exhaust system 440.

With reference to FIGS. 3 and 6, the engine 15 preferably includes a secondary air supply system 490 that supplies air from the air induction system to the exhaust system 440. More specifically, for example, hydrocarbon (HC) and carbon monoxide (CO) components of the exhaust gases can be removed by an oxidation reaction with oxygen ($O_2$) that is supplied to the exhaust system 440 from the air induction system. Thus, the air supply system 490 draws air from the induction system and guides the air into the exhaust system in accordance with an engine speed of the engine 15, in a known manner.

With reference to FIGS. 3, 7 and 8, the engine 15 has a valvetrain for actuating the intake and exhaust valves 210, 450. In the illustrated embodiment, a double overhead cam-type valvetrain is employed. That is, an intake cam shaft 505 actuates the intake valves 210 and an exhaust cam shaft 510 separately actuates the exhaust valves 450. The intake cam shaft 505 extends generally horizontally over the intake valves 210 from fore to aft parallel to the center plane CP, and the exhaust cam shaft 510 extends generally horizontally over the exhaust valves 450 from fore to aft also in parallel to the center plane CP.

Both the intake and exhaust cam shafts 505, 510 are journaled by the cylinder head member 165 with a plurality of cam shaft caps (not shown). The cam shaft caps holding the cam shafts 505, 510 are affixed to the cylinder head member 165. A cylinder head cover member 515 extends over the cam shafts 505, 510 and the cam shaft caps, and is affixed to the cylinder head member 165 to define a cam shaft chamber. The secondary air supply device 490 preferably is affixed to the cylinder head cover member 515. Additionally, the air supply device 490 is desirably disposed between the intake air box 215 and the engine body 203.

The intake cam shaft 505 has cam lobes associated with respective intake valves 205, and the exhaust cam shaft 510 also has cam lobes associated with the respective exhaust valves 445. The intake and exhaust valves 210, 450 normally close the intake and exhaust ports 205, 445 by a biasing force of springs. When the intake and exhaust cam shafts 505, 510 rotate, the cam lobes push the respective valves 210, 445 to open the respective ports 205, 445 by overcoming the biasing force of the spring. The air thus can enter the combustion chambers 170 when the intake valves 205 open. In the same manner, the exhaust gases can move out from the combustion chambers 170 when the exhaust valves 445 open.

The crankshaft 139 preferably drives the intake and exhaust cam shafts 505, 510 via a valvetrain drive 516. The valvetrain drive 516 includes an intake camshaft sprocket 517, an exhaust camshaft sprocket 520, a drive sprocket 525, and a flexible transmitter 530. In the illustrated embodiment, the flexible transmitter 530 is a timing chain.

The intake camshaft sprocket 517 is connected to the intake camshaft 505. The exhaust cam shaft sprocket 520, in turn, is connected to the exhaust cam shaft 510. The timing chain 530 is wound around the drive and driven sprockets 525, 517, 520. One of ordinary skill manner will appreciate that a belt and sheve arrangement can also be used in place of the timing chain 530 and sprockets 517, 520, 525.

The drive sprocket 525 and timing chain 530 both reside within the valvetrain drive chamber 196. A chain tensioner 535 is configured to maintain tension in the timing chain 530 during operation.

When the crankshaft 139 rotates, the drive sprocket 525 drives the driven sprockets 517, 520 via the timing chain 530, and thus intake and exhaust cam shafts 505, 510 also rotate. The rotational speed of the cam shafts 505, 510 are reduced to half of the rotational speed of the crankshaft 139 because of the difference in diameters of the drive and driven sprockets.

With reference to FIG. 8, as noted above, the bearing 195 is disposed between the drive gear 137 and the sprocket 525. By providing a bearing as such, the diameter 199 at bearing 195 can be smaller than the diameter 200 at bearing 194. This has the effect of reducing the overall weight of the crankshaft as noted above as well as making the crankshaft easier to manufacture and tune for the engine.

In operation ambient air enters the internal cavity 35 defined in the hull 20 through the air ducts 105. The air is then introduced into the plenum chamber 220 defined by intake box 215 through the air inlet ports 221 and through the air filter element 222. The air then flows through the air filter element 222 and is drawn into charge formers 400. The majority of the air in the plenum chamber 220 is supplied to the combustion chambers 170.

Throttle valves in the charge formers 400 regulate an amount of air permitted to pass to the combustion chambers 170. The opening angles of the throttle valves are controlled by the rider via the throttle lever and thus controls the air flow across the valves. The air hence flows into the combustion chambers 170 when the intake valves 210 open. At the same time, the charge formers 400 introduce an air/fuel mixture into the intake ports 205 under the control of the ECU. Air/fuel charges are thus formed and delivered to the combustion chambers 170.

The air/fuel charges are fired by the spark plugs 405 under the control of the ECU. The burnt charges, i.e., exhaust gases, are discharged to the body of water surrounding the watercraft 10 through the exhaust system 440. A relatively small amount of air in the plenum chamber 220 is supplied to the exhaust system 440 through the secondary air supply system 490 so as to aid in further combustion of any unburnt fuel remaining in the exhaust gases.

The combustion of the air/fuel charge causes the pistons 160 to reciprocate and thus causes the crankshaft 139 to rotate. The crankshaft 139 drives the driveshaft assembly 130 and the impeller shaft rotates in the hull tunnel 115. Water is thus drawn into the tunnel 115 through the inlet port 120 and then is just discharged rearward through the steering nozzle 145. The rider steers the steering nozzle 145 by the steering handlebar 65. The watercraft 10 thus moves as the rider desires.

Figure 9:
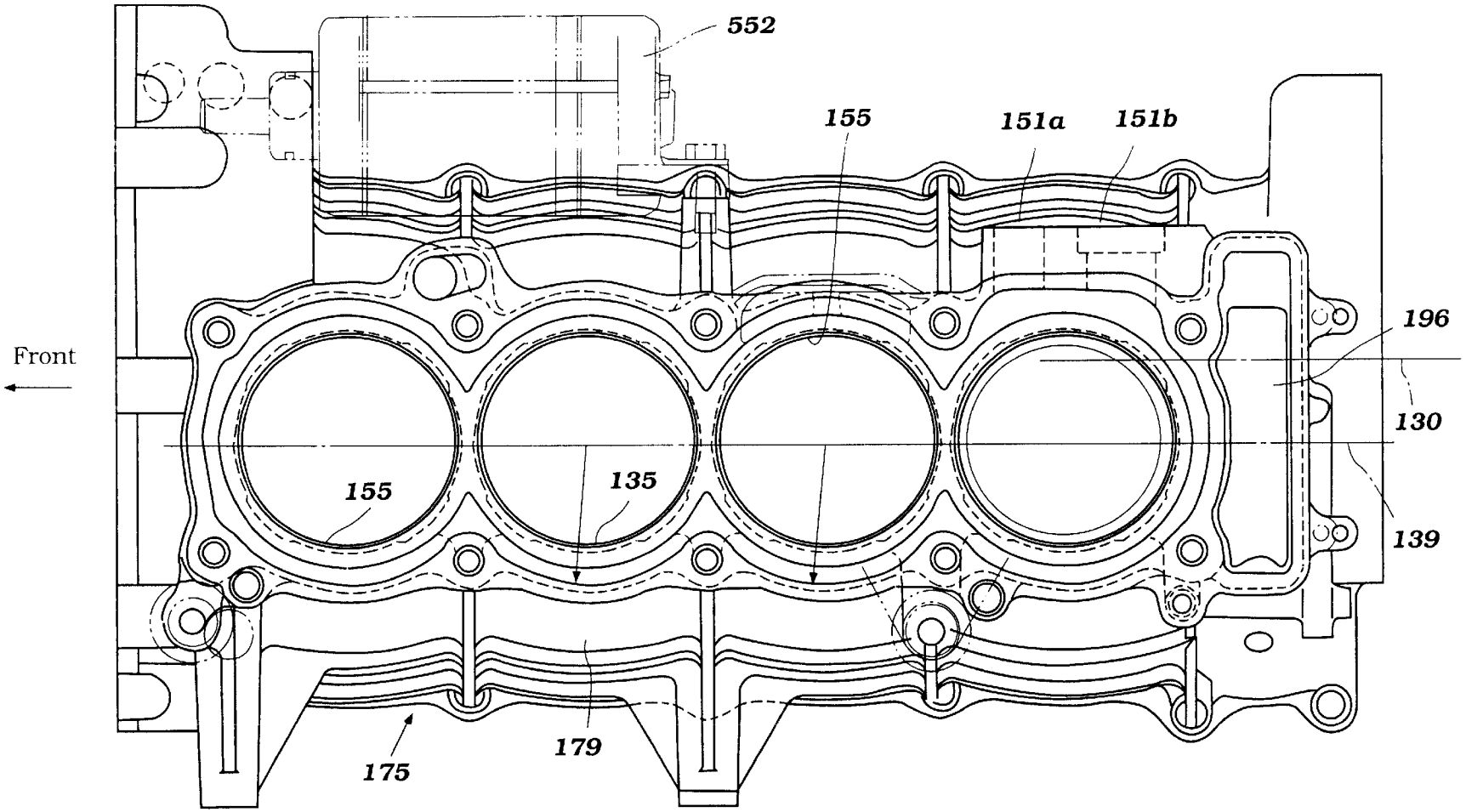
FIG. 9 is a bottom plan view of the engine with a crankcase member removed.

The engine 10 also includes other components relating to the engine operations. With reference to FIG. 7 the engine employs a flywheel magneto or AC generator 550 as one of such engine components. The flywheel magneto 550 generates electric power that is used for the engine operation as well as for electrical accessories associated with the watercraft 10. The flywheel magneto 550 is located at the forward end of the engine 15. A starter motor 552 (FIG. 9) rotates the crankshaft 139 for starting the engine in a manner well known to those of ordinary skill in the art.

The engine 15 of the watercraft 10 also includes a dry-sump type lubrication system for lubricating various components of the engine 15, illustrated in FIGS. 6–18. Under the dry-sump lubrication principle, lubricant is circulated throughout the engine 15 using a shallow lubricant reservoir and allowing the engine 15 to be mounted close to an inner surface of the lower hull section 25, as compared to engines employing wet-sump type lubrication systems. This lowers the center of gravity of the watercraft 10. Of course, certain features, aspects and advantages of the present invention can be used in wet-sump operations.

With reference to FIG. 6, the engine 15 includes an oil cap 181 connected to a lower surface of the lower crankcase member 177, which forms, at least in part, the shallow reservoir of the present dry sump lubrication system. Because the cylinder axes CA of the engine 15 are inclined with respect to the vertical direction, lubricant which drains downward the through the engine body 203 to the oil cap 181, tends to collect in the lowermost region of the engine body 203. Thus, oil draining through the engine body 203 collects along an engine side lubricant area 183. Oil that has collected in the area 183 is then drawn through the remainder of the lubrication system, described in greater detail below.

Figure 8A:
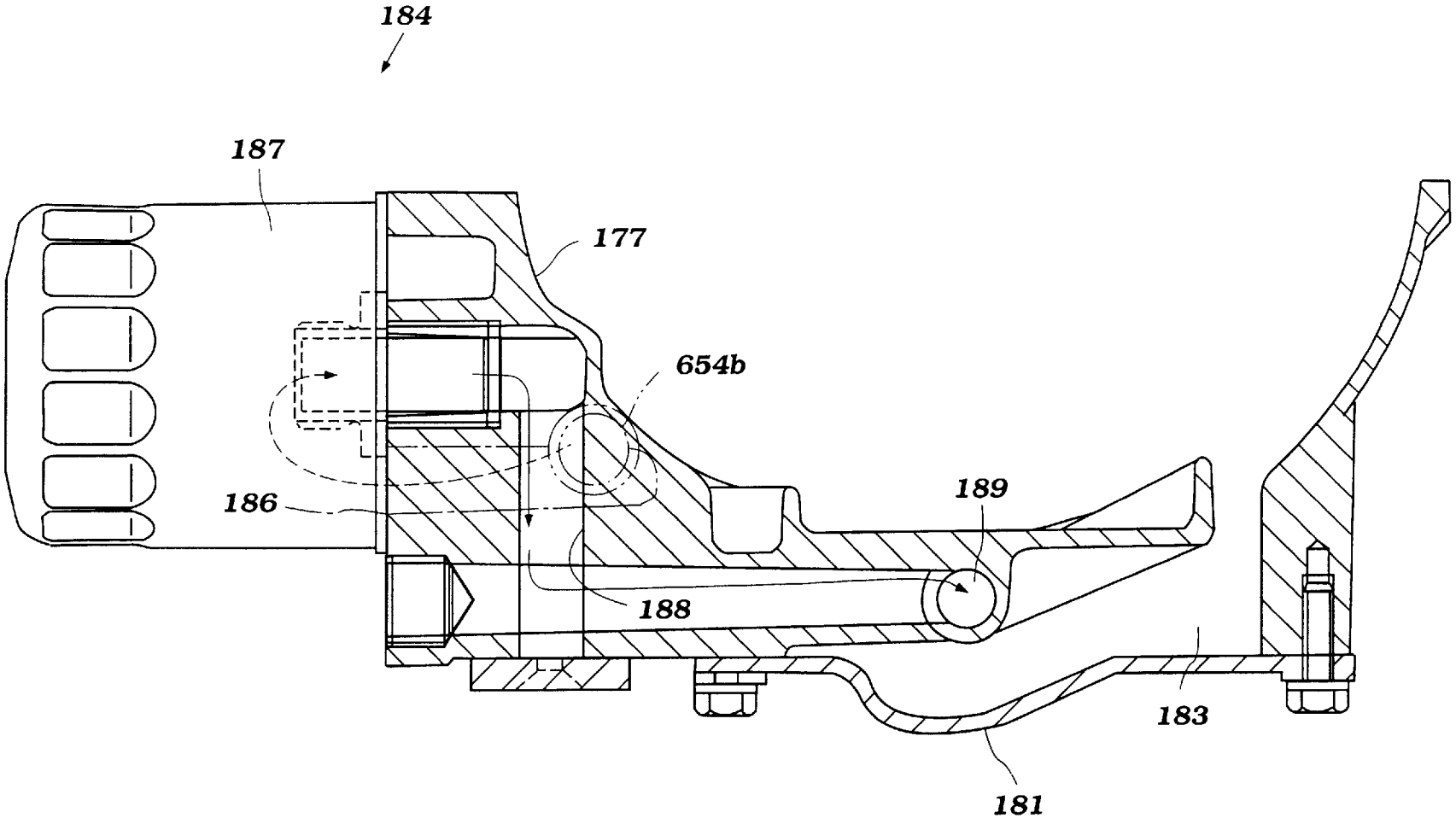
FIG. 8*a* is a partial cross-sectional view of the crankcase and an oil cap connected to an oil filter.
Figure 8B:
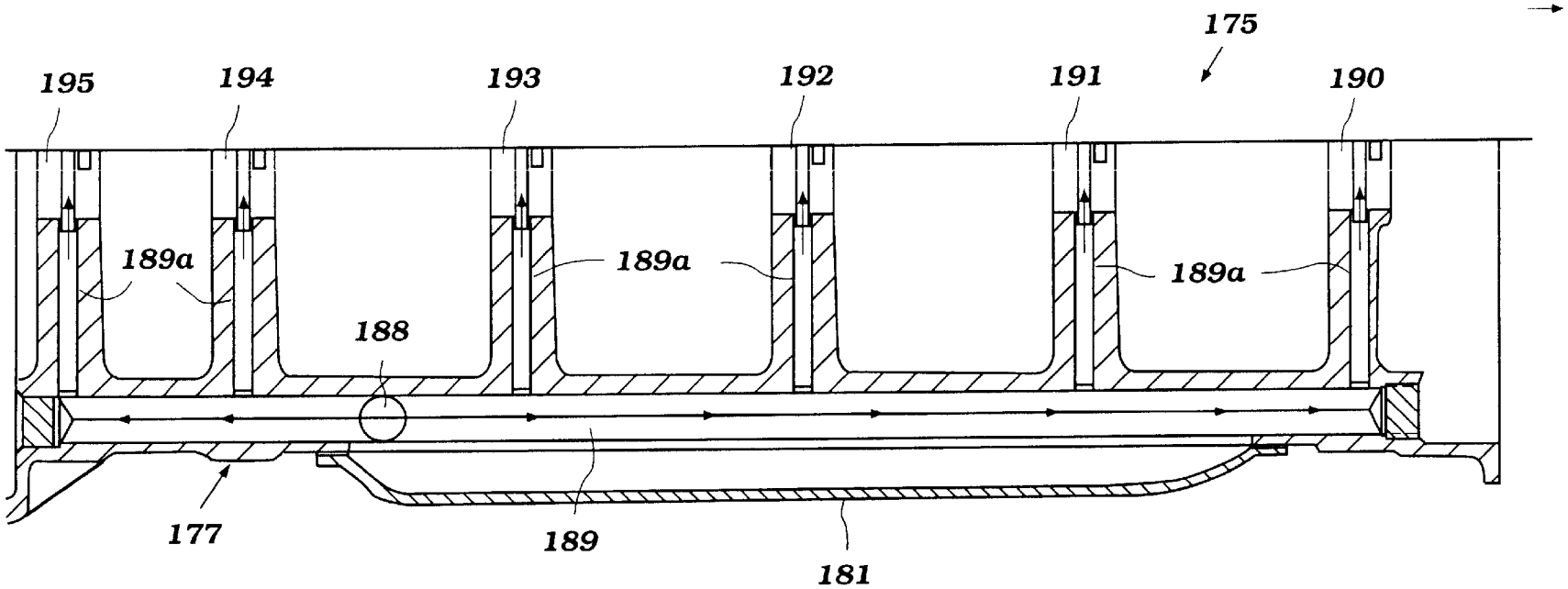
FIG. 8*b* is a partial cross-sectional view of the crankcase showing the oil cap, the main gallery, and the bearings.

With reference to FIGS. 8*a* and 8*b*, the lower crankcase member 177 also defines a lubricant filtration assembly 184. The filtration assembly 184 includes a supply passage 186, a filter 187, and a filtered oil passage 188 (FIG. 8*a*). The filtered oil passage 188 communicates with a main oil supply passage 189. The main oil supply passage 189 is connected to at least one engine oil gallery defined in the engine body 203. Preferably, the main oil supply passage 189 is connected to at least a plurality of oil galleries 189*a* which supply oil to the bearings 190, 191, 192, 193, 194, 195 (FIG. 8*b*).

In operation, oil is supplied to the filtration assembly 184 through the supply passage 186 from an oil pump, described in greater detail below. Oil from the supply passage 186 flows through the filter 187 and into the filtered oil passage 188. Oil flowing into the filtered oil passage 188, flows into the main will supply passage 189 and into the various oil galleries, such as for example, without limitation, 189*a*.

Figure 8C:
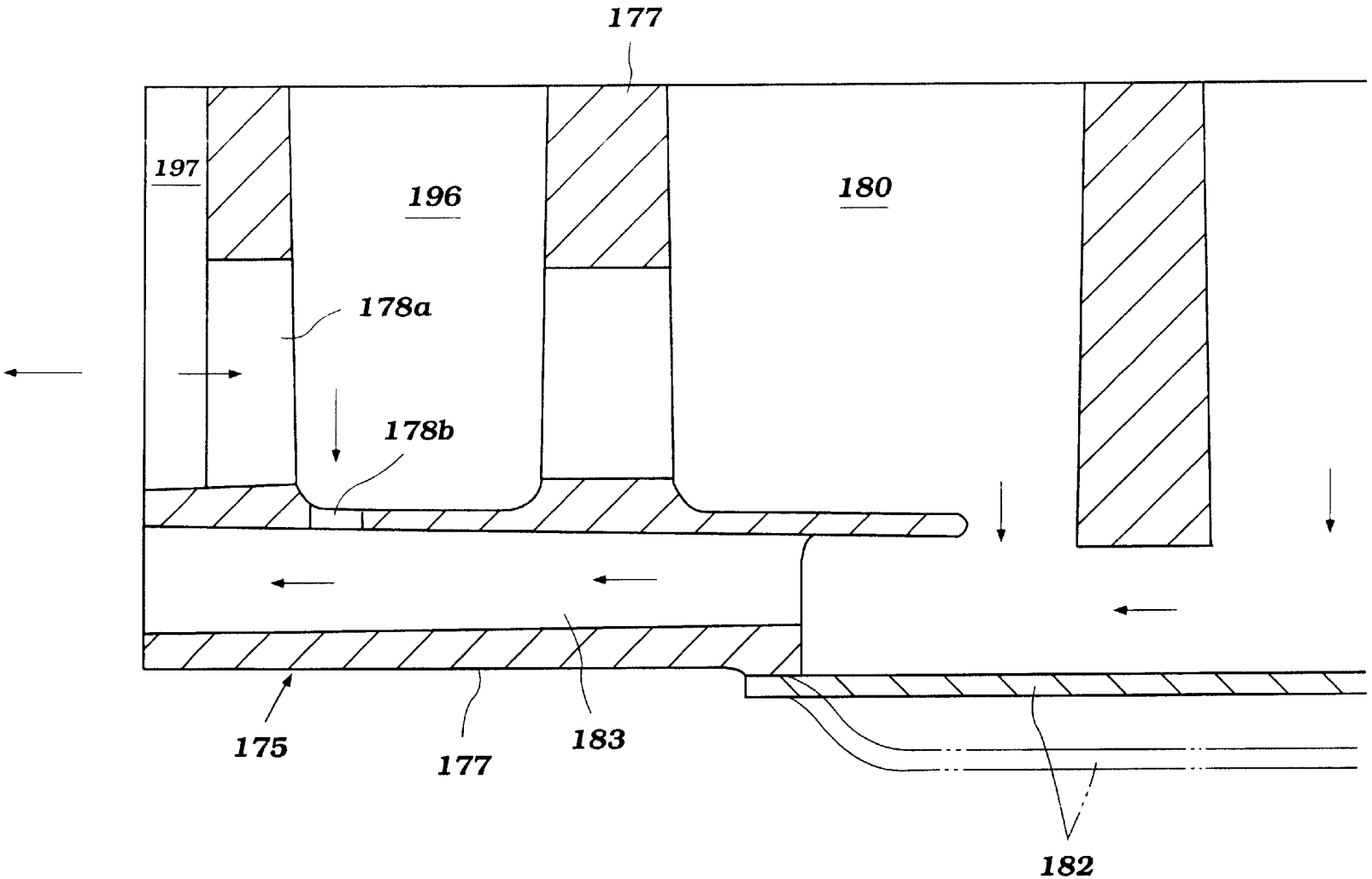
FIG. 8*c* is a partial sectional view of a lower portion of the crankcase shown in FIG. 8*a,* including an engine side collection area.

As noted above, the oil cap 181 collects oil that drains to the bottom of the engine body 203. With reference to FIG. 8*c*, the lower crankcase member 177 preferably includes a plurality of oil drains which allow oil to drain from the various portions of the lower crankcase member 177 into the engine side collection area 183. In the illustrated embodiment, the lower crankcase member 177 includes drain passages 178*a*, 178*b* which are configured to allow oil to drain from the gearbox 197 and the valvetrain drive chamber 196 to the engine side collection area 183.

Figure 8D:
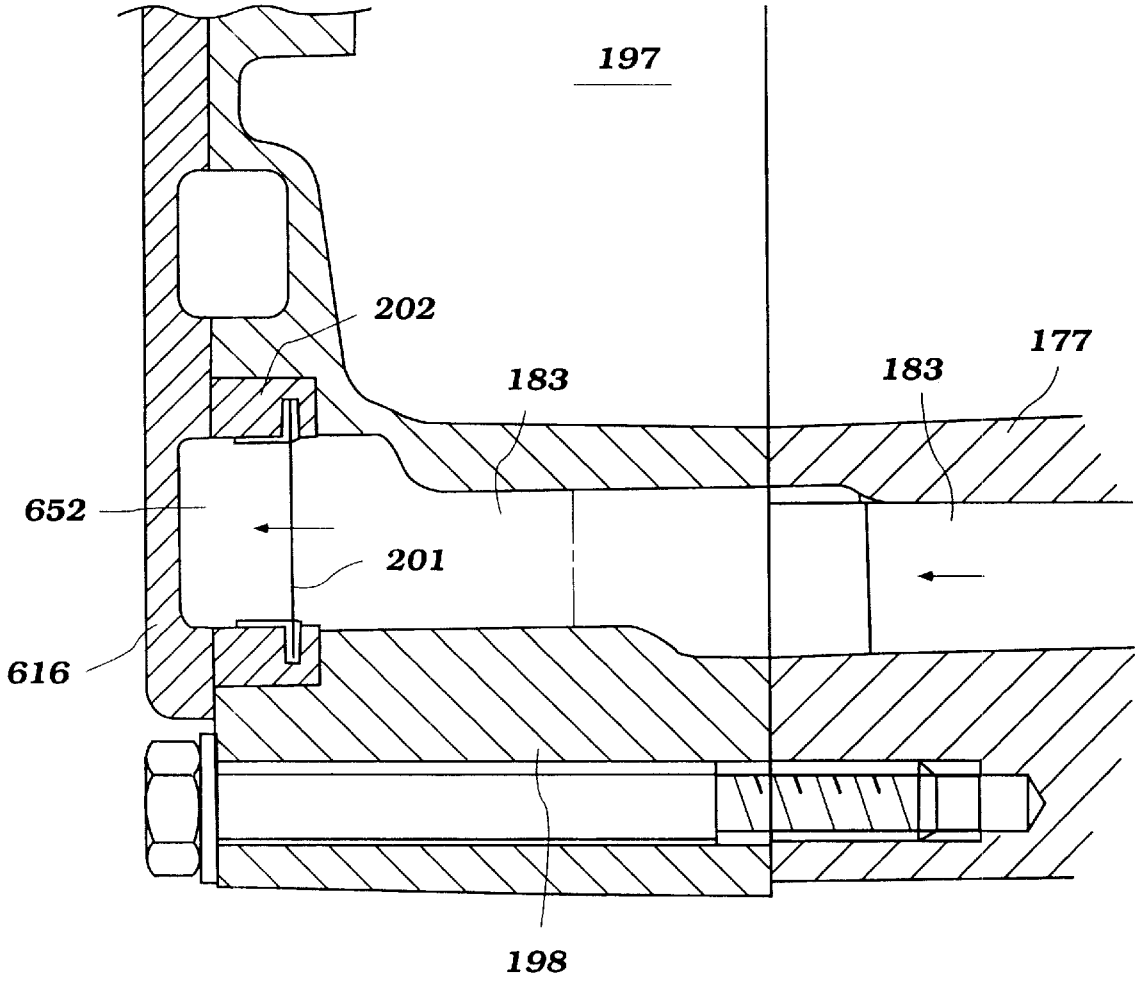
FIG. 8*d* is a partial sectional view of rearward portion of the crankcase chamber shown in FIG. 8*c*.

With reference to FIG. 8*d*, the engine side collection area 183 extends beneath the gearbox 197, rearwardly toward an oil scavenge passage, described in greater detail below. Preferably, a strainer 201 mounted in a rubber stopper 202, is disposed at a rearward end of the engine side collection area 183 to prevent foreign particles from entering the scavenge passage.

With reference to FIGS. 6, 8, and 11, the lubrication system includes a pump assembly unit 600 and oil tank 605. The pump assembly unit 600 is mounted at a rear surface of the crankcase member 175. The oil tank 605, which is preferably made of an aluminum alloy, is mounted above the pump unit 600.

With reference to FIG. 11, the pump assembly unit 600 comprises a first pump 610, a second pump 612, a pump housing 614, a first pump cover 616, an oil pump driven gear 617 and a second pump cover 618 mounted on the side of the pump assembly farthest from the oil pump driven gear 617.

Each of the pumps 610, 612 are generally axially aligned with and are connected to a pump shaft 620, as is the pump shaft driven gear 617. In the illustrated embodiment, the first pump 610 is situated farthest from the crankshaft 139 and the second section pump 612 is located closest to the crankshaft 139. Additionally, the oil pump shaft 620 comprises a front portion 626 with a groove 627 which receives a protruding part 628 or a second portion 629. The pumps 610, 612 are mounted on the second portion 629 of the oil pump shaft 620.

With reference to FIG. 6, the pump shaft driven gear 617 is driven by the drive gear 137 which is connected to the crankshaft 139. In another mode, the pump shaft driven gear 617 is driven by the impeller shaft driven gear 135 which is driven by the drive gear 137 mounted on the crankshaft 139.

As noted above, the pump assembly 600 and the oil tank 605 are supported on the engine body 203 by plurality of cover members 198, 616, and 618 on which are, in turn, supported by the crankcase 175.

Figure 13:
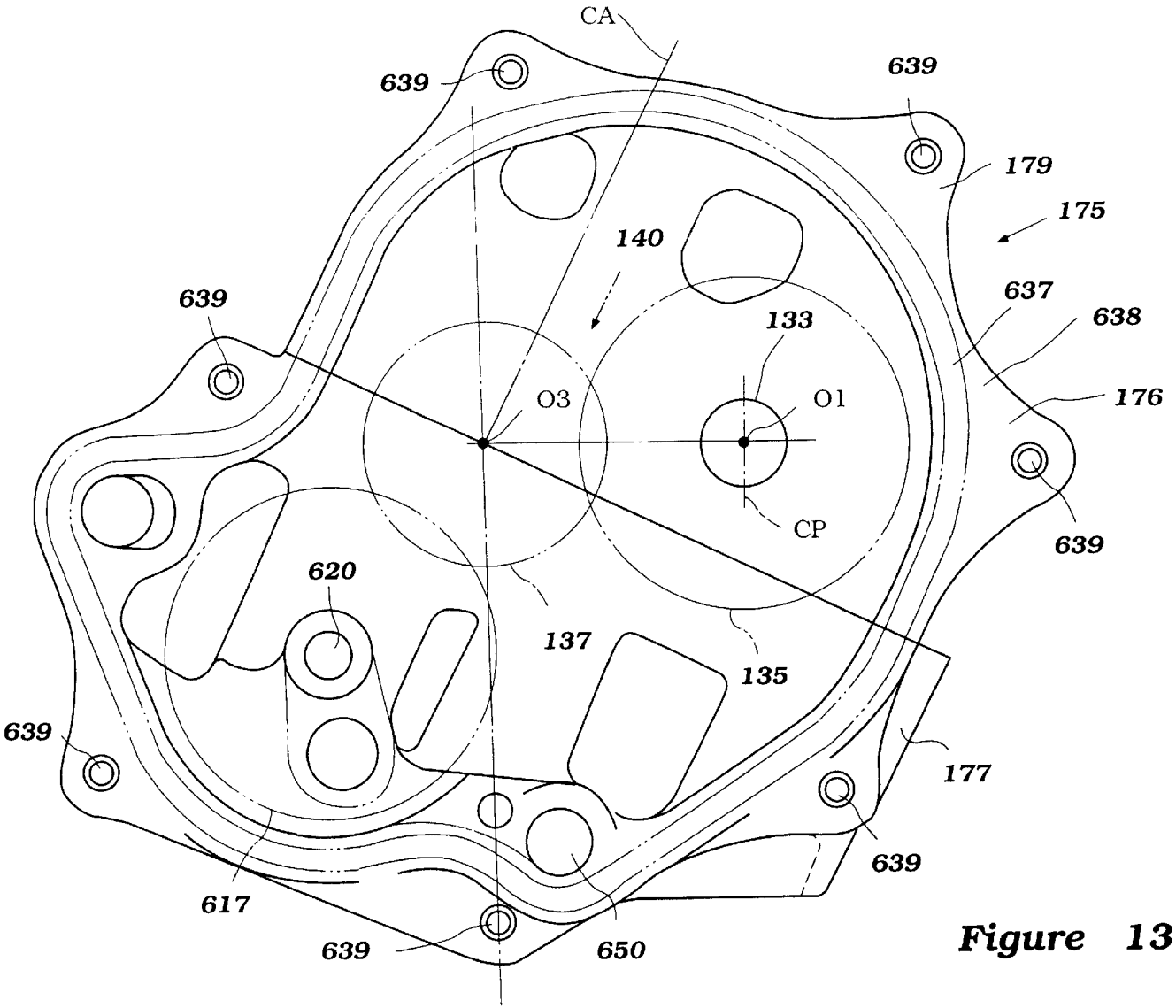
FIG. 13 is a rear elevational view of the crankcase with a gear cover removed, as viewed along section line 13—13 shown in FIG. 8.

FIG. 13 is a rear elevational view of a rearward facing surface 176 of the crankcase member 175 with the cover members 198, 616, and 618 removed. Additionally, the gears 137, 135, and 617 are shown in phantom. As noted above, the crankcase member 175 has an upper crankcase member 179 and a lower crankcase member 177. The rearward facing surface 176 of the crankcase member 175 spans the upper and lower crankcase members 179, 177.

The crankcase members 177, 179 have a gear cover mounting surface 637 which extends around the perimeter of the rearward facing surface 176. Additionally, the crankcase members 177, 179 define a flange 638 extending circumferentially around the mounting surface 637. The flange 638 includes mounting apertures 639 for receiving threaded fasteners.

The lower crankcase member 177 also includes an engine side oil collection aperture 650. As noted above, the axes CA of the cylinder bores 155 are inclined relative to a vertical axis, toward the starboard side. Thus, as oil from the interior of the engine body 203 drains downwardly toward the crankcase, the oil collects along the side of the engine body 203 in a lower portion and along the starboard side of the crankcase. The oil collection aperture 650 is thus aligned with the starboard side of the interior of the crankcase, which defines the engine side collection area 183.

With reference to FIG. 13, the drive gear 137 of the reduction gear pair 140 is centered on axis O3. The drive shaft 133 and the driven gear 135 are located on axis O1, which is offset laterally from axis O3 and is aligned with the plane CP. The oil pump shaft 620, which drives an oil pump driven gear 617, is disposed at an elevation between the engine side collection aperture 650 and the output shaft assembly 130 (shown in FIG. 7).

Figure 14:
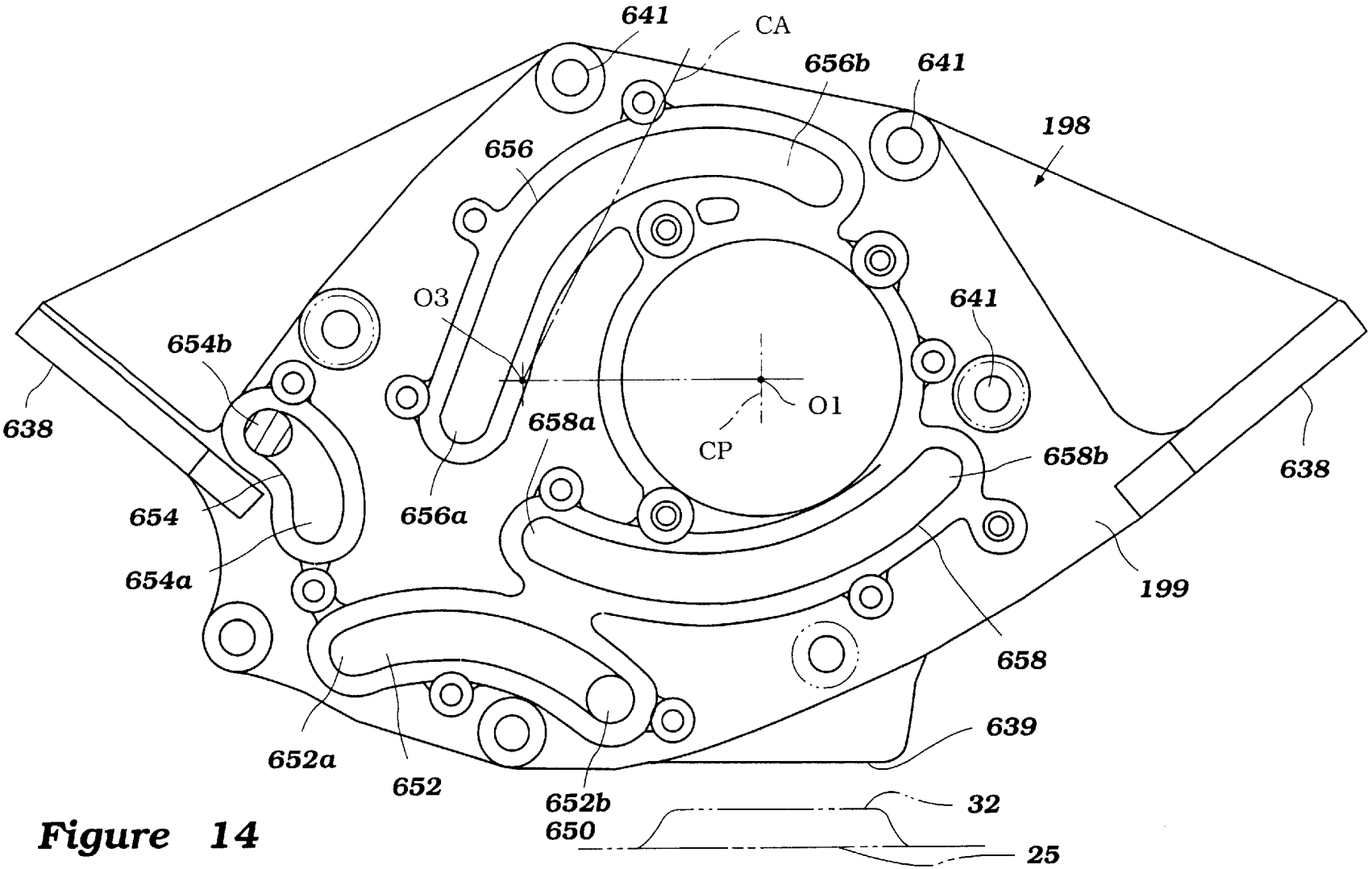
FIG. 14 is a rear elevational view of the gear cover as viewed along section line 14—14 shown in FIG.

FIG. 14 is a rear elevational view of a rearward facing surface 199 of the gear cover 198. The gear cover 198 includes a plurality of mounting apertures 641 which are configured to be aligned with the apertures 639 formed on the upper and lower crankcase members 179, 177, such that threaded fasteners can pass through the apertures 641 and thereby mount the gear cover 198 to the engine body 203. The gear cover 198 can be made of various suitable materials, including aluminum alloy. The cover 198 is formed with a through-hole to receive the driveshaft 133. When mounted on the crankcase member 175, mounting surfaces 638 mate with corresponding surfaces on the side crankcase member 175 so that the driveshaft hole is centered on axis O1. Also, an abutting portion 639 abuts stopper surface 32 affixed to the hull 25 to prevent the engine from shifting with respect to the hull 25 as the watercraft operates.

The gear cover 198 also includes a plurality of recesses or grooves which are configured to cooperate with the cover 616 to form oil passages 652, 654, 656 and 658 which connect the pumps 610, 612 with other portions of the lubrication system. The connections of the oil passages 652, 654, 656, and 658, are described in greater detail below.

Figure 15:
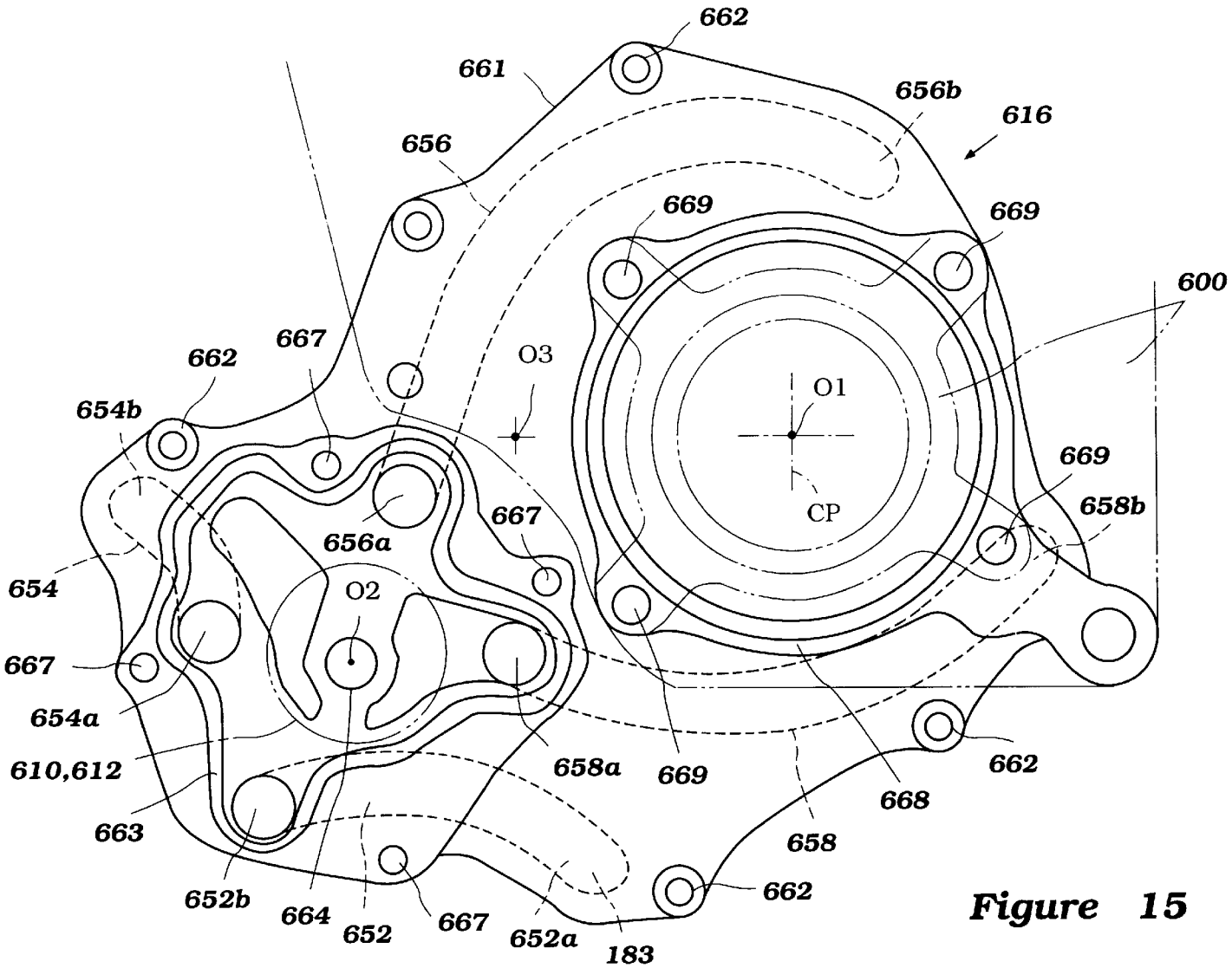
FIG. 15 is a rear elevational view of a first pump cover showing engine side lubrication passages in phantom, as viewed along line 15—15 of FIG. 16.

With reference to FIG. 15, the cover 616 includes a flange portion 661 extending circumferentially around the cover 616. The flange portion 661 includes a plurality of mounting apertures 662 configured to receive threaded fasteners, such that such fasteners can extend through the apertures 662, as well as the apertures 641 provided on the cover 198 into the apertures 639 disposed on the upper and lower crankcase members 179, 177. As such, threaded fasteners can be used to support the cover 616 and the gear cover 198 to the engine body 203.

As noted above, the cover 616 cooperates with the rearward facing surface 199 of the gear cover 198 to define the oil passages 652, 654, 656, and 658. The oil passages 652, 654, 656, and 658 are illustrated in phantom lines in FIG. 15.

The cover 616 includes an oil tank mounting surface 668. The mounting surfaces 668 includes a plurality of mounting apertures 669 configured to receive mounting bosses for aligning the oil tank 600 therewith, described in more detail below.

The cover 616 also defines an oil pump housing mounting surface 663. The mounting surface 663 extends circumferentially around an oil pump shaft aperture 664. As illustrating FIG. 15, the oil passages 652, 654, 656, 658, each include a pump end 652*a*, 654*a*, 656*a*, 658*a*, respectively, which open through the cover 616 at a position within the oil pump housing mounting surface 663. Additionally, the oil passages 652, 654, 656, 658, each include a distal end 652*b*, 654*b*, 656*b*, 658*b*, respectively. The connections between the distal ends 652*b,* 654*b,* 656*b,* 650*b,* and other portions of the lubrication system is set forth below in greater detail.

A plurality of mounting apertures 667 are disposed circumferentially around the mounting surface 663. The apertures 667 are configured to receive fasteners, such as threaded fasteners, for mounting the oil pump housing 614 thereto.

Figure 12:
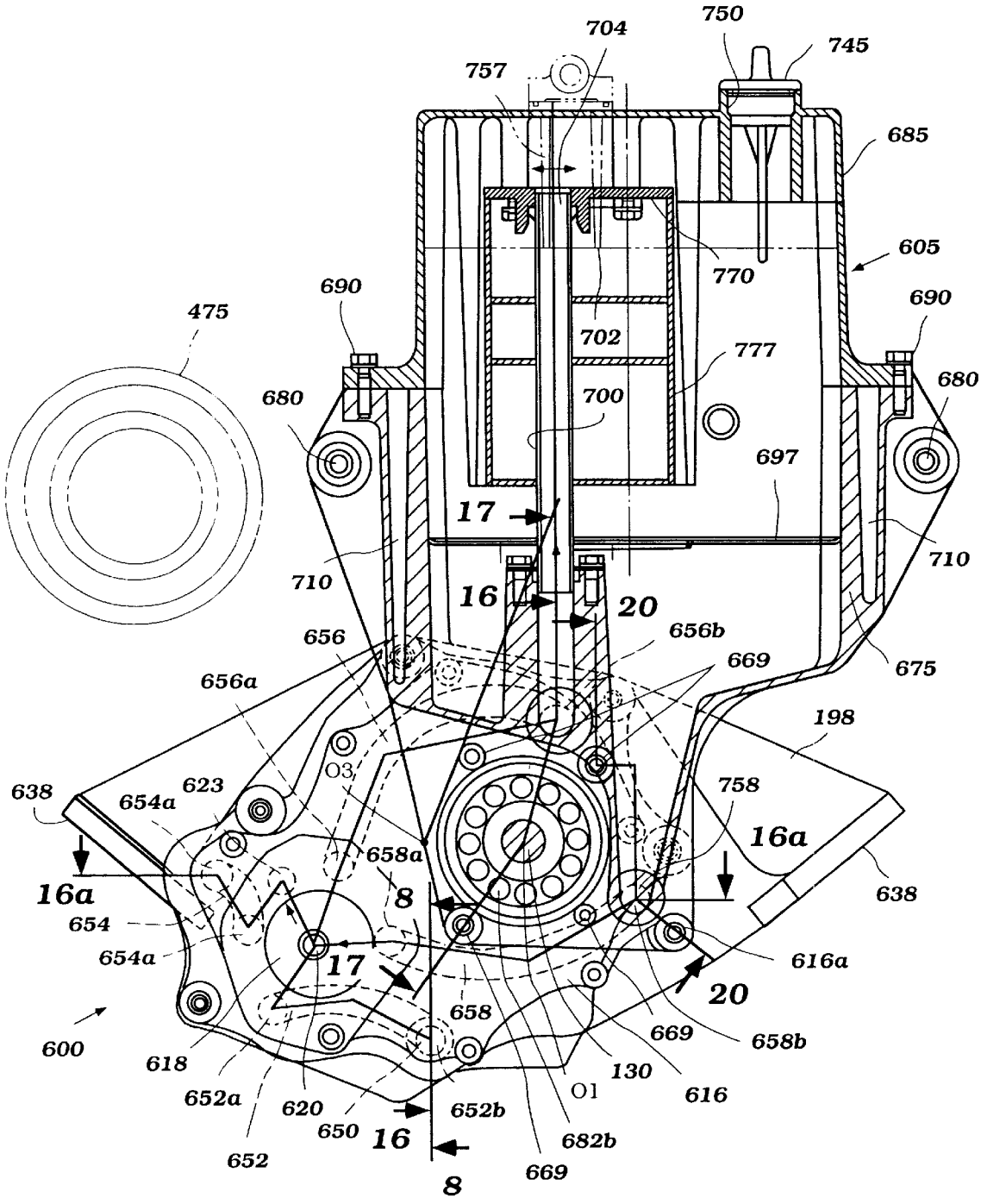
FIG. 12 is a partial cross-sectional and rear elevational view of the engine shown in FIG. 6.
Figure 16:
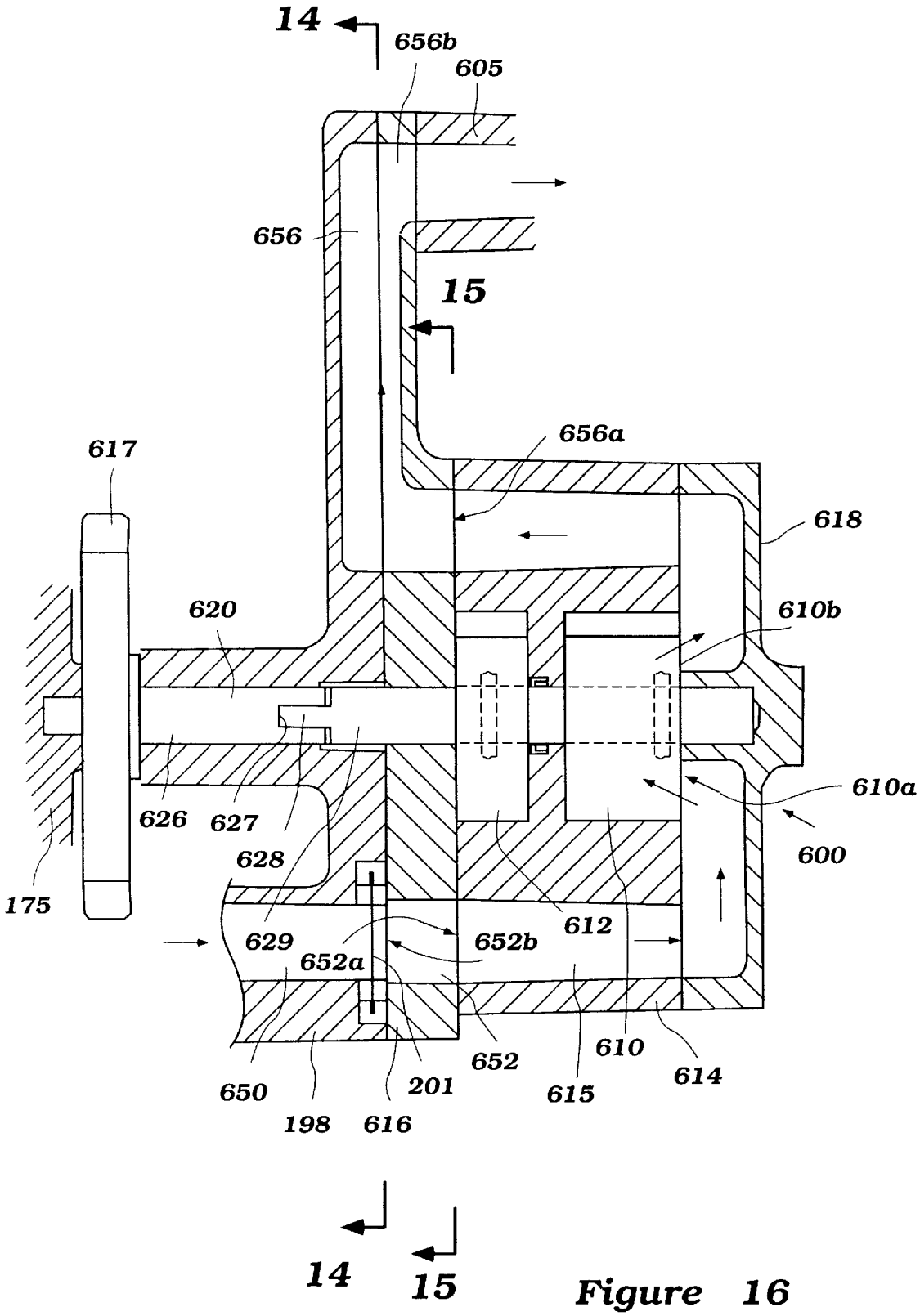
FIG. 16 is a partial cross-sectional view of the oil pump taken along section line 16—16 shown in FIG. 12.

FIG. 16 is a cross-sectional view of the oil pump assembly 600 taken along section line 16—16 shown in FIG. 12. As shown in FIG. 16, the pump housing 614 defines an oil pump intake chamber 615. The oil pump intake chamber 615 is connected to the pump end 652*a* of the passage 652. The distal end 652*b* of the passage 652 is connected to the engine side collection opening 650. A downstream end of the oil pump intake chamber 615 is connected to an inlet 610*a* of the pump 610.

The pump 610 also includes an outlet 610*b*. The outlet 610*b* is connected to the pump end 656*a* of the passage 656. The distal end 656*b* of the passage 656 is connected to the oil tank 605.

In operation, as the oil pump shaft 620 is rotated, oil is drawn from the engine side collection area 183, through the aperture 650 and into the inlet 610*a* of the pump 610. The pump discharges the oil through the outlet 610*b* into the passage 656. Thus, the pump 610 serves as a scavenge oil pump and the passage 656 serves as a supply conduit to the oil tank 605.

Figure 16A:
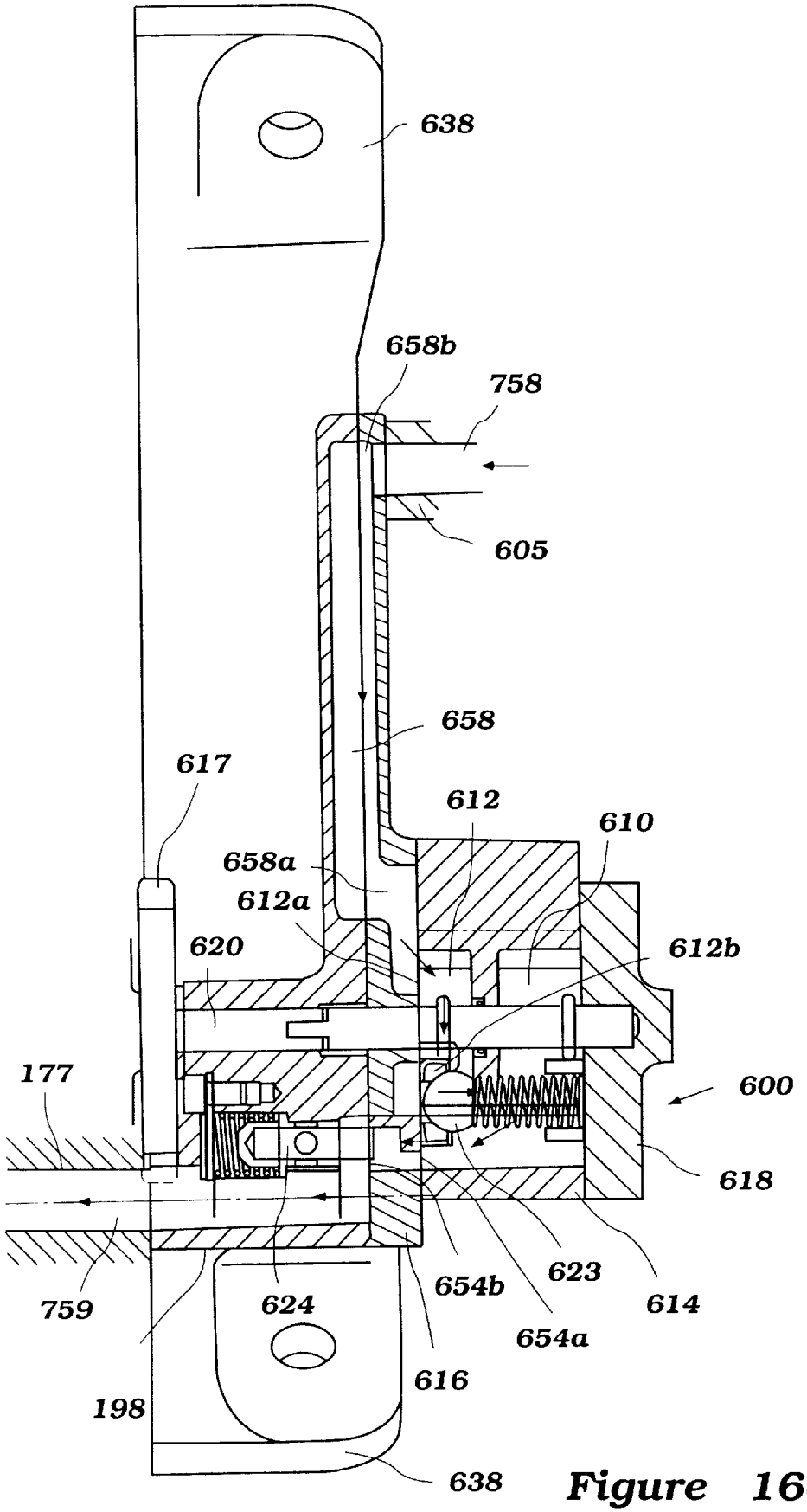
FIG. 16*a* is a is a cross-sectional view of the oil pump taken along section line 16*a*–16*a* of FIG. 12.

With reference to FIG. 16*a,* the pump housing 614 also houses the pump 612. An inlet 612*a* of the pump 612 is connected to the passage 658 at the pump end 658*a*. The distal end 658*b* of the passage 658 is connected to an outlet of the oil tank 605.

An outlet 612*b* of the pump 612 is connected to a check valve 623, and downstream from the check valve 623, to the pump end 654*a* of the passage 654. The distal end 654*b* of the passage 654 is connected to the oil filter supply passage 186, described above with reference to FIG. 8*a*.

In operation, as the pump shaft 620 is rotated, the pump 612 draws oil from the oil tank 605 through the passage 658. The oil, being driven by the pump 612, passes through the check valve 623 and into the passage 654. From the passage 654, the oil passes into the oil filter supply passage 186 and thus, through the oil filter assembly 184 as described above with reference to FIG. 8*a*.

With reference to FIGS. 8 and 12, the lubricant tank 605 is comprised of a lower body 675 defining a lower portion of the lubricant tank 605 and an upper body 685 defining an upper portion of the lubricant tank 605.

The lower body 675 is secured to the engine body 203 by a plurality of mounting bolts 680. Additionally, the oil tank 605 is secured to the oil tank mounting surface 668 (FIG. 15).

Figure 17:
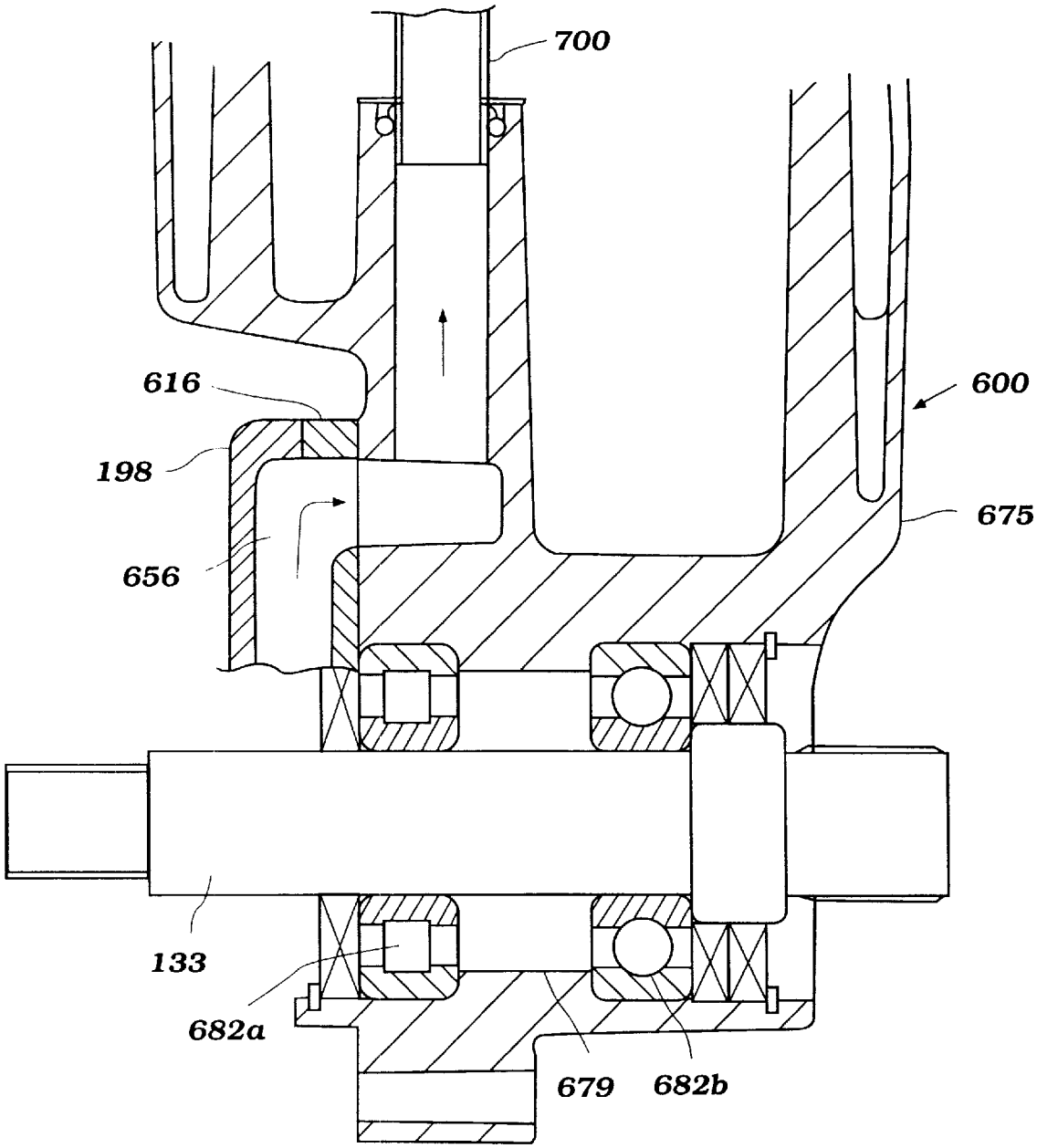
FIG. 17 is a partial cross-sectional view of the crankcase taken along section line 17—17 of FIG. 12.

With reference to FIGS. 11 and 17, the tank 605 is sealed against the shaft 133 with an arrangement of seals and bearings. In the illustrated embodiment, the tank 605 includes an output shaft aperture 679. A first sealing member 681*a* provides a seal between a forward end of the shaft 133 and the aperture 679, and second and third seals 681*b,* 681*c* provide seals between the aperture 679 and the rear end of the shaft 133. Additionally, bearings 682*a,* 682*b* journal the shaft 133 for rotation within the aperture 679. Retaining rings 683*a,* 683*b* are disposed at the outer sides of the sealing members 681*a,* 681*c* to secure the seals in place.

The upper body 685 of the tank 605 is secured by bolts 690 to the top of the lower body 675. The lubricant tank 605 also includes a vapor separator 695 that is located inside the tank body 605 and extends within the upper and lower bodies 675, 685. A baffle 697 extends horizontally across the cavity formed in the lower body 675. A connection pipe 700 extends upwardly through the upper and lower bodies 675, 685. The connection pipe 700 is connected to a first outlet passage 702 via outlet port 704, as shown in FIG. 12. The connection is sealed by sealing ring 705.

With reference to FIGS. 8 and 12, the upper body 685 closes an upper opening of the lower body 675. The upper body 685 includes a ventilation hose coupling member 740 and lubricant cap 745 with an integral lubricant level gauge. The lubricant cap 745 normally closes a lubricant filling port 750 (FIG. 12). When it is desired to add oil to the tank 605, the cap 745 can be removed, and oil can be poured into the tank 605 through the filling port 750.

With reference to FIG. 8, the ventilation hose coupling member 740 is coupled to a hose 755 for delivering vapors, such as oil, fuel, and/or water vapors, inside the lubricant tank 605 to the air intake system, described above. The coupling member 740 is connected to the lubricant tank 605 by communication passage 760 formed in the upper body 685. In the illustrated arrangement, a ball-type check valve 765 is positioned in a communication passage 760 for preventing the passage of lubricant into the intake system from the lubricant tank 605.

With reference to FIG. 12, the vapor separator 695 is configured to separate vapors from the lubricant delivered from the first and second pumps 610, 612. The vapor separator 695 is comprised of an upper cover 770. The vapor separator 695 also includes panels 775 that form a labyrinth passage between vertical plates 777. A pipe 780 penetrates the panels 775. The pipe 780 surrounds the connection pipe 700.

With reference to FIGS. 7 and 8, the lubricant port 704 guides the lubricant from the connection pipe 700 towards the vapor separator 695. The lubricant then passes through the vapor separator 695, which separates vapors from the lubricant. Vapors are allowed to escape from the oil tank through projecting pipe 757 into the coupling member 740 and the ventilation hose 755. Lubricant drains downwardly into a lower end of the lower body 675, where an outlet 758 is disposed for allowing oil to be drawn from the tank 605.

Figure 18:
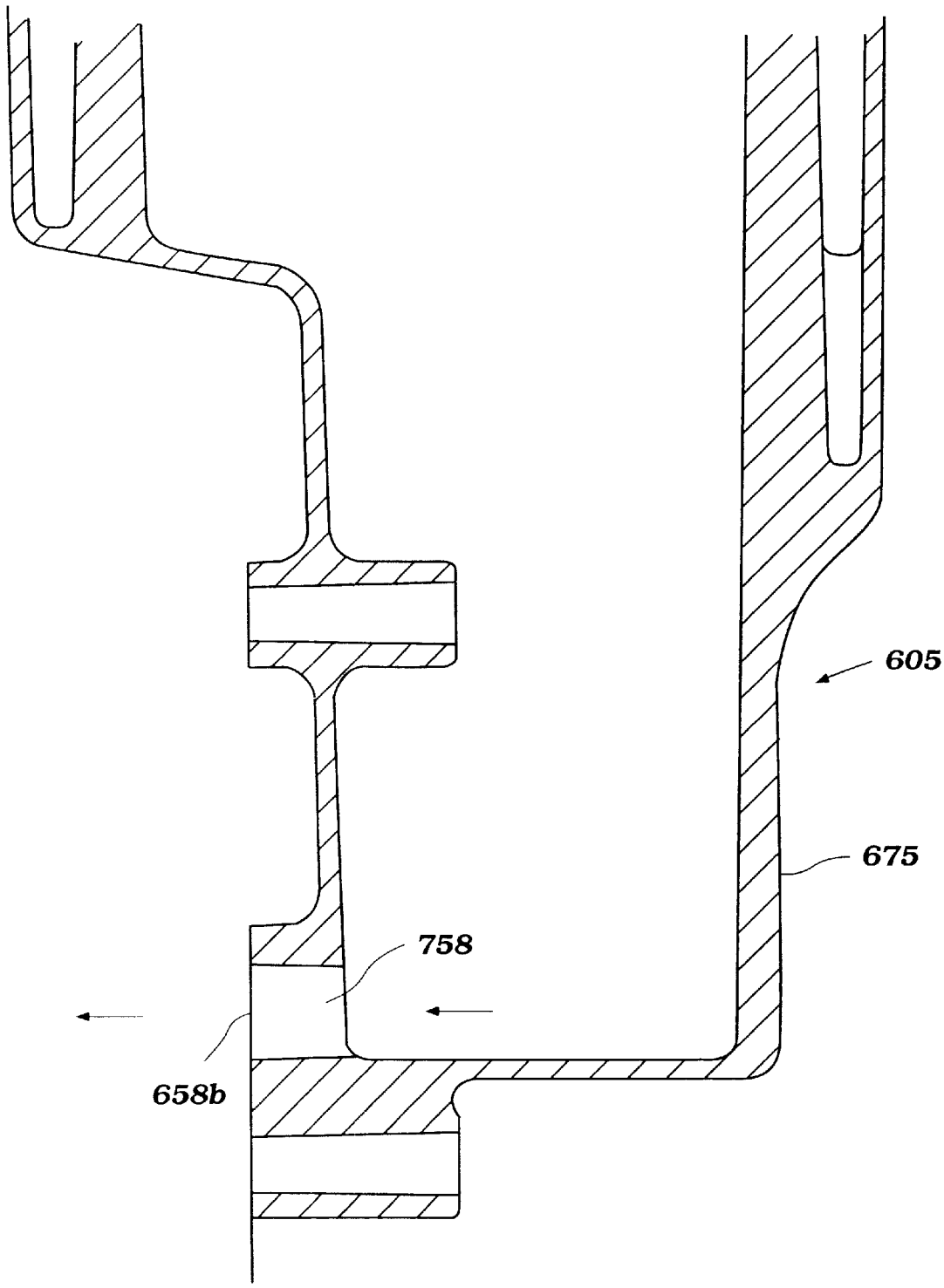
FIG. 18 is a cross-sectional view of a lower portion of the oil tank shown in FIG. 7.

With reference to FIG. 18, lubricant within the tank body 675 is provided to the oil pump assembly 600 through the passage 658. The distal end 658*b* of the passage 658 communicates with the tank body 675 through the outlet 758. The oil pump 612 receives lubricant from the oil passage 658 and pumps it to the passage 654

Although this invention has been described in terms of certain preferred embodiments, other embodiments apparent to those of ordinary skill in the art are also within the skill of this invention. Accordingly, the scope of the invention is intended to be defined only by the claims that follow.

What is claimed is:

1. A watercraft comprising a hull defining an engine compartment therein, a propulsion device configured to propel the hull, an internal combustion engine powering the propulsion device, the internal combustion engine comprising an engine body defining at least one combustion chamber therein, a crankshaft rotatably journaled at least partially within the engine body and having a first end and a second end, a valvetrain having at least one valve controlling a flow of air into the combustion chamber and at least a second valve controlling a flow of exhaust gases out of the combustion chamber, a valvetrain drive configured to transmit torque from the crankshaft to the valvetrain, the valvetrain drive communicating with the crankshaft at a first position proximate the first end of the crankshaft, a drive gear mounted to the first end of the crankshaft, the drive gear driving an impeller shaft assembly, and at least a first bearing supporting the crankshaft at a position between the first position and the drive gear, the distance from the second end to the first position is less than the distance from the second end to the drive gear.

2. A watercraft according to claim 1, wherein the engine body includes a valvetrain drive chamber defined therein.

3. A watercraft according to claim 1 additionally comprising a gear box connected to a rear end of the engine body, the gear box enclosing the drive gear.

4. A watercraft according to claim 1, wherein the valvetrain comprises at least one cam shaft driving the first and second valves, the valvetrain drive transmitting torque from the crankshaft to the cam shaft.

5. A watercraft according to claim 4, wherein the valvetrain drive comprises a first drive member rotatably connected on the crankshaft, a second drive member rotatably connected to the cam shaft, and a flexible transmitter transmitting torque between the first and second drive members.

6. A watercraft according to claim 1 additionally comprising a plurality of bearings supporting the crankshaft, the bearings being spaced along the crankshaft between the first bearing and the second end of the crankshaft.

7. A watercraft according to claim 1, wherein the valvetrain drive comprises a first drive member rotatably connected on the crankshaft, and a second drive member rotatably connected to the valvetrain.

8. A watercraft comprising a hull defining an engine compartment therein, a propulsion device configured to propel the watercraft, an internal combustion engine configured to drive the propulsion device, the internal combustion engine comprising an engine body defining at least one combustion chamber therein, a crankshaft rotatably journaled at least partially within the engine body and having a first end and a second end, a drive gear connected to the first end of the crankshaft, a driven gear driven by the drive gear, the driven gear connected to a drive shaft assembly, the drive shaft assembly driving an impeller disposed in the propulsion device, and an oil pump having an oil pump gear driven by the driven gear.

9. A watercraft according to claim 8, wherein the oil pump is configured to circulate oil through at least one oil gallery defined in the engine body.

10. A watercraft according to claim 8, wherein the drive gear and the driven gear define a gear reduction set such that the impeller rotates at a lower angular velocity than the crankshaft.

11. A watercraft according to claim 8, wherein the engine body and the oil pump are configured to define a dry-sump lubrication system.

12. A watercraft according to claim 8 additionally comprising a cover member supported by a rear end of the engine body, the cover member covering the drive and driven gears.

13. A watercraft according to claim 12, wherein the cover member defines a gear box, the gear box having a drain configured to allow oil to flow out of the gear box and into an oil collection passage defined in the engine body.

14. A watercraft comprising a hull defining an engine compartment therein, a propulsion device configured to propel the watercraft, an internal combustion engine disposed in the engine compartment and configured to drive the propulsion device, the internal combustion engine comprising an engine body defining at least one combustion chamber therein, a piston cooperating with the engine body to define the combustion chamber, a crankshaft rotatably journaled at least partially within the engine body, an output shaft assembly having a first end driven by the crankshaft and a second end connected to an impeller disposed in the propulsion device, a lubrication system configured to circulate lubricant through at least one lubricant gallery defined in the engine body, the lubrication system comprising at least one oil collection passage disposed in a lower portion of the engine body, and an oil pump having an oil pump shaft, wherein the oil pump shaft and the output shaft assembly are driven by a drive gear rotatably connected to the crankshaft the oil pump being between the drive gear and the propulsion device.

15. A watercraft comprising a hull defining an engine compartment therein, a propulsion device configured to propel the watercraft, an internal combustion engine disposed in the engine compartment and configured to drive the propulsion device, the internal combustion engine comprising an engine body defining at least one combustion chamber therein, a piston cooperating with the engine body to define the combustion chamber, a crankshaft rotatably journaled at least partially within the engine body, an output shaft assembly having a first end driven by the crankshaft and a second end connected to an impeller disposed in the propulsion device, a lubrication system configured to circulate lubricant through at least one lubricant gallery defined in the engine body, the lubrication system comprising at least one oil collection passage disposed in a lower portion of the engine body, an oil pump having an oil pump shaft disposed at an elevation between the output shaft assembly and the oil collection passage, and a cover member covering a first end of the oil pump shaft and the first end of the output shaft assembly, and an oil tank supported by the cover member.

16. A watercraft according to claim 15, wherein the oil tank supports at least a portion of the output shaft assembly.

17. A watercraft according to claim 16, wherein the oil tank includes an output shaft aperture including at least one bearing journalling the portion of the output shaft assembly for rotation.

18. A watercraft comprising a hull defining an engine compartment therein, a propulsion device configured to propel the watercraft, an internal combustion engine disposed in the engine compartment and configured to drive the propulsion device, the internal combustion engine comprising an engine body defining at least one combustion chamber therein, a piston cooperating with the engine body to define the combustion chamber, a crankshaft rotatably journaled at least partially within the engine body, an output shaft assembly having a first end driven by the crankshaft and a second end connected to an impeller disposed in the propulsion device, a lubrication system configured to circulate lubricant through at least one lubricant gallery defined in the engine body, the lubrication system comprising an oil tank supported by the engine body and at least one oil pump configured to circulate oil between the oil tank and at least one oil gallery defined in the engine body, the oil tank supporting at least a portion of the output shaft assembly.

19. A watercraft according to claim 18 additionally comprising a plurality of bearings journalling the portion of the output shaft assembly for rotation about an output shaft axis.

20. A watercraft according to claim 19, wherein the output shaft axis is aligned with a center plane of the watercraft.

21. A watercraft according to claim 18 additionally comprising a cover member, wherein the cover member defines, at least in part, at least a first oil passage connecting the oil pump with an oil collection passage defined in the engine body.

22. An internal combustion engine comprising an engine body defining at least one combustion chamber, a crankshaft journaled for rotation at least partially within the engine body, the crankshaft having a first end and a second end, at least one piston cooperating with the engine body to define the combustion chamber, a valvetrain configured to control a flow of air into and exhaust gas out of the combustion chamber, a valvetrain drive assembly configured to transmit torque from the crankshaft to the valvetrain for operating the valvetrain, the valvetrain drive assembly having a first drive member mounted to the crankshaft, a second drive member connected to the crankshaft and driving an output shaft, both the first and second drive members being disposed proximate the first end of the crankshaft, and a bearing being disposed between the first and second drive members, the distance from the second end to the first drive member is less than the distance from the second end to the second drive member.

23. An engine according to claim 22, wherein the engine body includes a valvetrain drive chamber defined therein.

24. An engine according to claim 22, additionally comprising a gear box connected to a rear end of the engine body, the gear box enclosing the second drive member.

25. An engine according to claim 22, wherein the valvetrain comprises at least one cam shaft driving first and second valves, the valvetrain drive transmitting torque from the crankshaft to the cam shaft.

26. An engine according to claim 25, wherein the valvetrain drive comprises a first drive member rotatably connected on the crankshaft, a second drive member rotatably connected to the cam shaft, and a flexible transmitter transmitting torque between the first and second drive members.

27. An engine according to claim 22 additionally comprising a plurality of bearings supporting the crankshaft, the bearings being spaced along the crankshaft between the first end and the second end of the crankshaft.

28. An engine according to claim 22, wherein the valvetrain drive comprises a first drive member rotatably connected on the crankshaft, and a second drive member rotatably connected to a cam shaft.

29. An internal combustion engine comprising an engine body defining at least one combustion chamber, a crankshaft journaled for rotation at least partially within the engine body, the crankshaft having first and second ends, at least one piston cooperating with the engine body to define the combustion chamber, a drive gear connected to the first end of the crankshaft, an output shaft having a driven gear driven by the drive gear, a lubrication system configured to circulate lubricant through at least one lubricant gallery defined in the engine body, the lubrication system comprising at least one oil pump having an oil pump gear driven by the driven gear.

30. An engine according to claim 29, wherein the oil pump is configured to circulate oil through at least one oil gallery defined in the engine body.

31. An engine according to claim 29, wherein the drive gear and the driven gear define a gear reduction set such that the output shaft rotates at a lower angular velocity than the crankshaft.

32. An engine according to claim 29, wherein the engine body and the oil pump are configured to define a dry-sump lubrication system.

33. An engine according to claim 29, additionally comprising a cover member supported by a rear end of the engine body, the cover member covering the drive and driven gears.

34. An engine according to claim 33, wherein the cover member defines a gear box, the gear box having a drain configured to allow oil to flow out of the gear box and into an oil collection passage defined in the engine body.

35. An internal combustion engine comprising an engine body defining at least one combustion chamber, a crankshaft journaled for rotation at least partially within the engine body, the crankshaft having first and second ends and a rotational axis, at least one piston cooperating with the engine body to define the combustion chamber, an output shaft assembly driven by the crankshaft, a lubrication system configured to circulate lubricant through at least one lubricant gallery defined in the engine body, the lubrication system comprising at least one lubricant collection passage disposed in a lower portion of the engine body, and an oil pump having an oil pump shaft disposed at an elevation between the output shaft assembly and the lubricant collection passage, wherein the oil pump shaft and the output shaft assembly are driven by a drive gear rotatably connected to the crankshaft, the oil pump shaft extending beyond one of the first and second ends of the crankshaft relative to the rotational axis of the crankshaft.

36. An internal combustion engine comprising an engine body defining at least one combustion chamber, a crankshaft journaled for rotation at least partially within the engine body, the crankshaft having first and second ends, at least one piston cooperating with the engine body to define the combustion chamber, an output shaft assembly driven by the crankshaft, a lubrication system configured to circulate lubricant through at least one lubricant gallery defined in the engine body, the lubrication system comprising at least one lubricant collection passage disposed in a lower portion of the engine body, and an oil pump having an oil pump shaft disposed at an elevation between the output shaft assembly and the lubricant collection passage, a cover member covering a first end of the oil pump shaft and the first end of the output shaft assembly, and an oil tank supported by the cover member.

37. An internal combustion engine comprising an engine body defining at least one combustion chamber, a crankshaft journaled for rotation at least partially within the engine body, the crankshaft having first and second ends, at least one piston cooperating with the engine body to define the combustion chamber, an output shaft assembly driven by the crankshaft, a lubrication system configured to circulate lubricant through at least one lubricant gallery defined in the engine body, the lubrication system comprising at least one lubricant collection passage disposed in a lower portion of the engine body, and an oil pump having an oil pump shaft disposed at an elevation between the output shaft assembly and the lubricant collection passage, a cover member covering a first end of the oil pump shaft and the first end of the output shaft assembly, and an oil reservoir supported by the cover member, wherein the oil reservoir supports at least a portion of the output shaft assembly.

38. An engine according to claim 37, wherein the oil reservoir includes an output shaft aperture including at least one bearing journalling the portion of the output shaft assembly for rotation.

39. An engine according to claim 36, wherein the cover member defines, at least in part, at least a first oil passage connecting the oil pump with the oil collection passage.

40. An internal combustion engine comprising an engine body defining at least one combustion chamber therein, a crankshaft rotatably journaled at least partially within the engine body, an output shaft assembly having a first end driven by the crankshaft, a lubrication system configured to circulate lubricant through at least one lubricant gallery defined in the engine body, the lubrication system comprising an oil tank supported by the engine body and at least one oil pump configured to circulate oil between the oil tank and at least one oil gallery defined in the engine body, the oil tank supporting at least a portion of the output shaft assembly.

41. An engine according to claim 40 additionally comprising a plurality of bearings journalling the portion of the output shaft assembly for rotation about an output shaft axis.

42. An engine according to claim 41 in combination with a watercraft, wherein the output shaft axis is aligned with a center plane of the watercraft.

43. An engine according to claim 40 additionally comprising a cover member, wherein the cover member defines, at least in part, at least a first oil passage connecting the oil pump with an oil collection passage defined in the engine body.

44. A watercraft comprising a hull defining an engine compartment therein, a propulsion device configured to propel the hull, an internal combustion engine powering the propulsion device, the internal combustion engine comprising a plurality of cylinder bores with one piston slideably mounted in each cylinder bore, a crankshaft connected with each piston, a plurality of first bearings supporting the crankshaft, one of the first bearings being disposed on each side of each piston, a valvetrain having at least one valve controlling a flow of air into the engine and at least a second valve controlling the flow of exhaust gases out of the engine, a valvetrain drive configured to transmit torque from a crankshaft to the valvetrain, the valvetrain drive communicating with the crankshaft at a first position which is not between two of the first bearings, a drive gear mounted to the crankshaft at a second position that is not between two of the first bearings, and a second bearing supporting the crankshaft and being disposed between the first position and the second position.

* * * * *